US010823160B1

(12) United States Patent
Babcock

(10) Patent No.: US 10,823,160 B1
(45) Date of Patent: Nov. 3, 2020

(54) COMPACT PUMP WITH REDUCED VIBRATION AND REDUCED THERMAL DEGRADATION

(71) Applicant: Pumptec Inc., Anoka, MN (US)

(72) Inventor: Stephen E. Babcock, Lakeville, MN (US)

(73) Assignee: Pumptec Inc., Anoka, MN (US)

( * ) Notice: Subject to any disclaimer, the term of this patent is extended or adjusted under 35 U.S.C. 154(b) by 266 days.

(21) Appl. No.: 15/870,853

(22) Filed: Jan. 12, 2018

Related U.S. Application Data

(60) Provisional application No. 62/445,726, filed on Jan. 12, 2017.

(51) Int. Cl.

| | |
|---|---|
| ***F04B 1/053*** | (2020.01) |
| ***F04B 53/08*** | (2006.01) |
| ***F04B 53/10*** | (2006.01) |
| ***F04B 11/00*** | (2006.01) |

(52) U.S. Cl.
CPC ..... *F04B 11/005* (2013.01); *F04B 1/053* (2013.01); *F04B 53/08* (2013.01); *F04B 53/10* (2013.01); *F04B 2201/0802* (2013.01)

(58) Field of Classification Search
CPC ..... F04B 1/04; F04B 1/053; F04B 1/0531; F04B 1/047; F04B 1/0472; F04B 1/0421; F04B 9/02; F04B 9/04; F04B 11/005; F04B 53/16; F04B 39/122; F04B 39/125; F04B 39/06; F04B 53/08; F04B 2201/0802
See application file for complete search history.

(56) References Cited

U.S. PATENT DOCUMENTS

| | | | |
|---|---|---|---|
| 759,828 | A | 5/1904 | Olney |
| 935,655 | A | 10/1909 | Haire |
| 1,003,479 | A | 9/1911 | Lucas |
| 1,632,948 | A | 6/1927 | Cardenas |
| 1,736,593 | A | 11/1929 | Harm |
| RE18,303 | E | 2/1931 | Harm |
| 1,827,811 | A | 10/1931 | Derrick |
| 1,970,251 | A | 8/1934 | Rossman |
| 2,002,783 | A | 5/1935 | Long |
| 2,054,009 | A | 9/1936 | Thrush |

(Continued)

FOREIGN PATENT DOCUMENTS

| | | | |
|---|---|---|---|
| DE | 3400263 | A1 | 7/1985 |
| DE | 3413726 | A1 | 10/1985 |

(Continued)

*Primary Examiner* — Philip E Stimpert
(74) *Attorney, Agent, or Firm* — Albert W. Watkins

(57) ABSTRACT

A positive displacement reciprocating multi-cylinder pump has a pair of cams and associated bearings and yokes that cooperatively and positively reciprocate the pistons. The fluid flow paths are configured through specially designed intake and outlet manifolds to provide intrinsic cooling of the bearings through specially configured fluid flow paths at distal ends of the pump. An intentional head geometry that is identical for each piston may be readily machined using exterior bores. Each head defines a cylinder, captures both inlet and outlet one-way valves, and provides essential fluid flow paths about the cylinders. All bearings are of the sealed type, and no additional oil baths or the like are required, permitting the pump to be stored, transported, and used in any orientation.

5 Claims, 9 Drawing Sheets

(56) References Cited

U.S. PATENT DOCUMENTS 2,367,135 A 1/1945 Moon et al.
2,445,717 A 7/1948 Richards
2,461,121 A 2/1949 Markham
2,668,082 A 2/1954 Pasteur
2,739,537 A 3/1956 Sadler et al.
2,801,596 A 8/1957 Sewell
2,881,338 A 4/1959 Banning
2,940,466 A 6/1960 Speights
2,981,025 A 4/1961 Woodson
3,067,987 A 12/1962 Ballou et al.
3,092,037 A * 6/1963 Rhodes ..... F04B 1/0421 417/273
3,104,062 A 9/1963 Mahon
3,151,746 A 10/1964 Reustle et al.
3,174,436 A * 3/1965 Wanner ..... F04B 1/0536 417/273
3,209,485 A 10/1965 Griffin
3,223,040 A 12/1965 Dinkelkamp
3,266,737 A 8/1966 Nees
3,338,171 A 8/1967 Conklin et al.
3,410,477 A 11/1968 Hartley
3,487,577 A 1/1970 Sexton
3,512,375 A 5/1970 Madarasz et al.
3,513,586 A 5/1970 Meyer et al.
3,653,784 A 4/1972 Leitermann et al.
3,664,770 A 5/1972 Palmer
3,676,949 A 7/1972 Ramsey
3,707,305 A 12/1972 Kinkelder
3,765,605 A 10/1973 Gusmer et al.
3,765,802 A 10/1973 Leitermann et al.
3,770,060 A 11/1973 Forsyth et al.
3,782,026 A 1/1974 Bridges et al.
3,787,145 A 1/1974 Keyes et al.
3,793,762 A 2/1974 Stains
3,799,402 A 3/1974 Holmes et al.
3,801,229 A 4/1974 Henderson
3,809,496 A 5/1974 Hansen
3,815,621 A 6/1974 Robinson
3,831,849 A 8/1974 Studinger
3,889,881 A 6/1975 Cunningham et al.
3,894,690 A 7/1975 Hill
3,910,497 A 10/1975 Manor
3,926,369 A 12/1975 Pearce
3,963,038 A 6/1976 Jensen
3,964,774 A 6/1976 Wollin et al.
3,967,920 A 7/1976 Hill
3,979,063 A 9/1976 Query
3,980,231 A 9/1976 Trondsen
3,993,416 A 11/1976 Kato
4,004,602 A 1/1977 Cordis et al.
4,010,768 A 3/1977 Hechler, IV
4,026,196 A 5/1977 Olofsson
4,026,439 A 5/1977 Cocks
4,028,841 A 6/1977 Lundwall
4,050,629 A 9/1977 Query et al.
4,057,072 A 11/1977 Cook
4,073,606 A 2/1978 Eller
4,076,465 A 2/1978 Pauliukonis
4,085,171 A 4/1978 Baker et al.
4,089,624 A 5/1978 Nichols et al.
4,119,113 A 10/1978 Meginniss, III
4,153,393 A 5/1979 Cook
4,167,236 A 9/1979 Taubenmann
4,185,650 A 1/1980 Neves et al.
4,186,769 A 2/1980 Buyce
4,187,173 A 2/1980 Keefer
4,191,309 A 3/1980 Alley et al.
4,199,303 A 4/1980 Bairunas et al.
4,200,426 A 4/1980 Linnert
4,234,007 A 11/1980 Titone et al.
4,236,673 A 12/1980 Lake
4,243,523 A 1/1981 Pelmulder
4,273,261 A 6/1981 Krueger
4,278,205 A 7/1981 Binoche
4,288,326 A 9/1981 Keefer
4,317,468 A 3/1982 Schwartz et al.
4,317,647 A 3/1982 Haeuser
4,341,327 A 7/1982 Zeitz
4,350,179 A 9/1982 Bunn et al.
4,360,323 A 11/1982 Anderson
4,367,140 A 1/1983 Wilson
4,427,298 A 1/1984 Fahy et al.
4,432,470 A 2/1984 Sopha
4,433,577 A 2/1984 Khurgin et al.
4,434,056 A 2/1984 Keefer
4,436,493 A 3/1984 Credle, Jr.
4,437,812 A 3/1984 Abu-Shumays et al.
4,440,314 A 4/1984 Vetter et al.
4,445,470 A 5/1984 Chmielewski
4,452,631 A 6/1984 Burow, Jr. et al.
4,486,097 A 12/1984 Riley
4,487,333 A 12/1984 Pounder et al.
4,518,105 A 5/1985 Kuckens et al.
4,534,713 A 8/1985 Wanner
4,547,128 A 10/1985 Hayes
RE32,144 E 5/1986 Keefer
4,593,855 A 6/1986 Forsyth
4,601,378 A 7/1986 Pierce et al.
4,609,149 A 9/1986 Jessen
4,609,469 A 9/1986 Keoteklian
4,629,568 A 12/1986 Ellis, III
4,638,924 A 1/1987 Newsom
4,645,428 A 2/1987 Arregui et al.
4,645,599 A 2/1987 Fredkin
4,648,854 A 3/1987 Redington
4,650,792 A 3/1987 Underwood
4,651,903 A 3/1987 Pagliai
4,690,620 A 9/1987 Eickmann
4,699,023 A 10/1987 Bajulaz
4,702,416 A 10/1987 Pagliai et al.
4,705,461 A 11/1987 Clements
4,708,674 A 11/1987 Matsumoto
4,722,675 A 2/1988 Albarda
4,742,641 A 5/1988 Cretti
4,744,895 A 5/1988 Gales et al.
4,762,281 A 8/1988 Eberhardt
4,773,993 A 9/1988 Yoda et al.
4,778,356 A 10/1988 Hicks
4,778,597 A 10/1988 Bruzzi et al.
4,784,771 A 11/1988 Wathen et al.
4,789,100 A 12/1988 Senf
4,790,454 A 12/1988 Clark et al.
4,804,474 A 2/1989 Blum
4,804,475 A 2/1989 Sirinyan et al.
4,821,958 A 4/1989 Shaffer
4,850,812 A 7/1989 Voight
4,867,871 A 9/1989 Bowne
RE33,135 E 12/1989 Wanner et al.
4,886,190 A 12/1989 Kirschner et al.
4,887,559 A 12/1989 Hensel et al.
4,913,809 A 4/1990 Sawada et al.
4,921,133 A 5/1990 Roeser
4,929,347 A 5/1990 Imai et al.
4,934,567 A 6/1990 Vahjen et al.
4,941,596 A 7/1990 Marty et al.
4,944,882 A 7/1990 Ray et al.
4,955,943 A 9/1990 Hensel et al.
4,963,075 A * 10/1990 Albertson ..... F04B 43/026 417/221
4,978,284 A 12/1990 Cook et al.
4,999,209 A 3/1991 Gnekow
5,005,765 A 4/1991 Kistner
5,014,914 A 5/1991 Wallenas
5,027,978 A 7/1991 Roeser
5,030,065 A 7/1991 Baumann
5,032,065 A 7/1991 Yamamuro et al.
5,055,008 A 10/1991 Daniels et al.
5,057,212 A 10/1991 Burrows
5,058,768 A 10/1991 Lichfield
5,089,124 A 2/1992 Mahar et al.
5,095,647 A 3/1992 Zobele et al.
5,100,058 A 3/1992 Wei
5,100,699 A 3/1992 Roeser
5,102,312 A 4/1992 Harvey

(56) References Cited

U.S. PATENT DOCUMENTS 5,108,273 A 4/1992 Romanyszyn, Jr.
5,114,241 A 5/1992 Morrison
5,118,008 A 6/1992 Williams
5,133,483 A 7/1992 Buckles
5,167,493 A 12/1992 Kobari
5,170,912 A 12/1992 Du
5,173,039 A 12/1992 Cook
5,180,108 A 1/1993 Miyamoto
5,183,396 A 2/1993 Cook et al.
5,184,941 A 2/1993 King et al.
5,192,000 A 3/1993 Wandrick et al.
5,207,916 A 5/1993 Goheen et al.
5,221,192 A 6/1993 Heflin et al.
5,228,594 A 7/1993 Aslin
5,235,944 A 8/1993 Adachi
D340,458 S 10/1993 Wang
5,253,981 A 10/1993 Yang et al.
5,255,819 A 10/1993 Peckels
5,287,833 A 2/1994 Yashiro
5,297,511 A 3/1994 Suzuki
5,303,866 A 4/1994 Hawks, Jr.
5,331,364 A 7/1994 Borden
5,332,123 A 7/1994 Farber et al.
5,333,785 A 8/1994 Dodds et al.
5,344,291 A 9/1994 Antkowiak
5,354,182 A 10/1994 Niemiec et al.
5,355,122 A 10/1994 Erickson
5,355,851 A 10/1994 Kamiya
5,368,059 A 11/1994 Box et al.
5,370,269 A 12/1994 Bernosky et al.
D354,753 S 1/1995 Turner, III et al.
5,382,140 A 1/1995 Eisenbacher et al.
5,383,605 A 1/1995 Teague
5,383,770 A 1/1995 Hisahara
5,388,761 A 2/1995 Langeman
5,390,635 A 2/1995 Kidera et al.
5,403,490 A 4/1995 Desai
5,433,349 A 7/1995 Romanyszyn, Jr.
5,439,592 A 8/1995 Bellos et al.
5,490,939 A 2/1996 Gerigk et al.
5,494,414 A 2/1996 Steinhart et al.
5,511,524 A 4/1996 Kidera et al.
5,538,641 A 7/1996 Getty et al.
5,542,578 A 8/1996 Buckles
5,558,435 A 9/1996 Marjo
5,558,639 A 9/1996 Gangemi et al.
5,611,172 A 3/1997 Dugan et al.
5,613,839 A 3/1997 Buckley
5,630,383 A 5/1997 Kidera et al.
5,636,648 A 6/1997 O'Brien et al.
5,647,973 A 7/1997 Desaulniers
5,707,219 A 1/1998 Powers
5,779,449 A 7/1998 Klein
5,785,504 A 7/1998 Cote
5,799,871 A 9/1998 Theurer
5,823,752 A 10/1998 Hoenisch et al.
5,829,401 A 11/1998 Masuda
5,853,122 A 12/1998 Caprio
5,855,626 A 1/1999 Wiegner et al.
5,862,947 A 1/1999 Wiegner et al.
5,876,665 A 3/1999 Zalis
5,878,708 A 3/1999 Ruman
5,879,137 A 3/1999 Yie
5,908,183 A 6/1999 Fury
5,975,152 A 11/1999 Kluge
5,975,863 A 11/1999 Mazzucato
6,003,787 A 12/1999 Fisher
6,010,032 A 1/2000 Vermylen et al.
6,012,608 A 1/2000 Ridenour
6,022,473 A 2/2000 Mickelson
6,034,465 A 3/2000 Mckee et al.
6,036,116 A 3/2000 Bui
6,047,495 A 4/2000 Matsumura et al.
6,050,756 A 4/2000 Buchholz et al.
6,055,831 A 5/2000 Barbe
6,056,515 A 5/2000 Cuneo
6,070,764 A 6/2000 Cline et al.
6,074,551 A 6/2000 Jones et al.
6,089,835 A 7/2000 Suzuura et al.
6,098,646 A 8/2000 Hennemann et al.
6,109,361 A 8/2000 Henderson
6,110,375 A 8/2000 Bacchus et al.
6,113,797 A 9/2000 Al-Samadi
6,120,682 A 9/2000 Cook
6,139,748 A 10/2000 Ericson et al.
6,161,723 A 12/2000 Cline et al.
6,162,022 A 12/2000 Anderson et al.
6,162,023 A 12/2000 Newman
6,164,560 A 12/2000 Lehrke et al.
D436,968 S 1/2001 Cook
6,186,193 B1 2/2001 Phallen et al.
6,190,556 B1 2/2001 Uhlinger
6,194,160 B1 2/2001 Levin
6,199,770 B1 3/2001 King et al.
D441,935 S 5/2001 Cook
6,224,351 B1 * 5/2001 Simon ..... F04B 1/0421 417/273
6,247,838 B1 6/2001 Pozniak et al.
6,254,779 B1 7/2001 Jeffery et al.
6,257,843 B1 7/2001 Cook et al.
6,276,015 B1 8/2001 Cook
6,284,171 B1 9/2001 Nonomura et al.
6,293,756 B1 9/2001 Andersson
6,302,161 B1 10/2001 Heller et al.
6,305,169 B1 10/2001 Mallof
6,328,388 B1 12/2001 Mohr et al.
6,333,018 B2 12/2001 Bianchi et al.
6,334,579 B1 1/2002 Zarbi
6,336,794 B1 1/2002 Kim
6,374,781 B1 4/2002 Kato
6,378,779 B1 4/2002 Taylor
6,386,396 B1 5/2002 Strecker
6,398,521 B1 6/2002 Yorulmazoglu
6,409,375 B1 6/2002 Knight
6,422,183 B1 7/2002 Kato
6,439,860 B1 8/2002 Greer
6,452,499 B1 9/2002 Runge et al.
6,454,190 B1 9/2002 Cook
6,464,107 B1 10/2002 Brugger
6,491,494 B1 12/2002 Beckenbach et al.
6,527,524 B2 3/2003 Cook
6,547,529 B2 4/2003 Gross
6,548,528 B2 4/2003 Kimura
6,554,577 B2 4/2003 Park et al.
6,558,078 B2 5/2003 Sowry et al.
6,568,559 B2 5/2003 Miller et al.
6,581,855 B1 6/2003 Cook
6,607,668 B2 8/2003 Rela
D480,447 S 10/2003 Cook
D480,448 S 10/2003 Cook
D481,102 S 10/2003 Marshik
6,669,105 B2 12/2003 Bryan et al.
6,696,298 B2 2/2004 Cook et al.
D488,208 S 4/2004 Cook
6,718,948 B2 4/2004 Vahle et al.
D490,496 S 5/2004 Cook
6,735,945 B1 5/2004 Hall et al.
6,739,845 B2 5/2004 Woollenweber
6,742,765 B2 6/2004 Takano et al.
6,817,486 B2 11/2004 Yang
6,823,239 B2 11/2004 Sieminski
6,824,364 B2 11/2004 Ross et al.
6,841,076 B1 1/2005 Wobben
6,857,543 B2 2/2005 Kvam et al.
6,863,036 B2 3/2005 Kato
6,893,569 B2 5/2005 Zelechonok
6,896,152 B2 5/2005 Pittman et al.
6,897,374 B2 5/2005 Garber et al.
6,921,001 B1 7/2005 Hunt et al.
6,955,760 B2 10/2005 Iwata
6,974,052 B1 12/2005 d'Hond et al.
6,997,683 B2 2/2006 Allington et al.
7,007,826 B2 3/2006 Shapanus et al.
7,009,519 B2 3/2006 Leonard et al.

(56) References Cited

U.S. PATENT DOCUMENTS

| | | | |
|---|---|---|---|
| 7,050,886 | B2 | 5/2006 | Oberg et al. |
| 7,063,785 | B2 | 6/2006 | Hiraku et al. |
| 7,066,218 | B1 | 6/2006 | Fleming et al. |
| 7,066,353 | B2 | 6/2006 | Hammonds |
| 7,067,061 | B2 | 6/2006 | Bosetto et al. |
| 7,090,147 | B2 | 8/2006 | Lovett |
| 7,141,161 | B2 | 11/2006 | Ito |
| 7,147,827 | B1 | 12/2006 | Balisky |
| 7,168,636 | B2 | 1/2007 | Lebeda et al. |
| 7,207,260 | B2 | 4/2007 | Thierry et al. |
| 7,295,898 | B2 | 11/2007 | Lovett et al. |
| 7,395,948 | B2 | 7/2008 | Kogan |
| 7,523,603 | B2 | 4/2009 | Hagen et al. |
| 7,614,855 | B2 | 11/2009 | Cook |
| 7,753,290 | B2 | 7/2010 | Jacques et al. |
| D625,388 | S | 10/2010 | Cook |
| 7,823,323 | B2 | 11/2010 | Su |
| 7,866,512 | B2 | 1/2011 | Fertig |
| D635,218 | S | 3/2011 | Cook |
| 7,998,496 | B2 | 8/2011 | Su et al. |
| 8,196,399 | B1 | 6/2012 | Hauser et al. |
| 8,333,572 | B2 | 12/2012 | Hsieh |
| 8,511,516 | B2 | 8/2013 | Klopfenstein et al. |
| 9,316,216 | B1 | 4/2016 | Cook et al. |
| 2001/0048037 | A1 | 12/2001 | Bell et al. |
| 2002/0157413 | A1 | 10/2002 | Iwanami et al. |
| 2003/0103850 | A1 | 6/2003 | Szulczewski |
| 2003/0147755 | A1 | 8/2003 | Carter, III et al. |
| 2003/0160525 | A1 | 8/2003 | Kimberlin et al. |
| 2004/0033144 | A1 | 2/2004 | Rush |
| 2004/0035949 | A1 | 2/2004 | Elkins et al. |
| 2004/0136833 | A1 | 7/2004 | Allington et al. |
| 2004/0162850 | A1 | 8/2004 | Sanville et al. |
| 2004/0175278 | A1 | 9/2004 | Dexter et al. |
| 2004/0244372 | A1 | 12/2004 | Leavesley |
| 2004/0247461 | A1 | 12/2004 | Pflueger et al. |
| 2004/0265144 | A1 | 12/2004 | Fukanuma et al. |
| 2005/0019187 | A1 | 1/2005 | Whitworth et al. |
| 2005/0254970 | A1 | 11/2005 | Mayer et al. |
| 2006/0000854 | A1 | 1/2006 | Hornsby et al. |
| 2006/0086823 | A1 | 4/2006 | Colarusso et al. |
| 2006/0222524 | A1 | 10/2006 | Cook et al. |
| 2006/0228233 | A1 | 10/2006 | Cook |
| 2006/0261188 | A1 | 11/2006 | Ito et al. |
| 2007/0000947 | A1 | 1/2007 | Lewis et al. |
| 2007/0029255 | A1 | 2/2007 | D'Amato et al. |
| 2008/0296224 | A1 | 12/2008 | Cook et al. |
| 2009/0004032 | A1* | 1/2009 | Kaupert ..... F01D 11/001 417/365 |
| 2009/0068034 | A1 | 3/2009 | Cook |
| 2009/0074591 | A1 | 3/2009 | Courier |
| 2010/0127410 | A1 | 5/2010 | Drager |

FOREIGN PATENT DOCUMENTS

| | | | |
|---|---|---|---|
| EP | 0116879 | A1 | 8/1984 |
| FR | 1293065 | A | 4/1962 |
| GB | 1202877 | A | 8/1970 |
| GB | 2235021 | A | 2/1991 |

* cited by examiner

COMPACT PUMP WITH REDUCED VIBRATION AND REDUCED THERMAL DEGRADATION

CROSS REFERENCE TO RELATED APPLICATIONS

The present application claims the benefit of U.S. provisional patent application 62/445,726 filed Jan. 12, 2017 of like title and inventorship, the teachings and entire contents which are incorporated herein by reference.

BACKGROUND OF THE INVENTION

1. Field of the Invention

The present invention pertains generally to pumps, and more particularly to a piston type pump capable of pumping moderate volumes of liquid with reduced vibration and reduced thermal degradation, both which contribute to a quieter and longer life-cycle pump.

2. Description of the Related Art

Fluid pumps of many diverse constructions are found in countless devices to move an equally diverse set of fluids. In fact, fluid pumps are ubiquitous with both living things and machinery.

The impellers necessary to move fluids can take on such diverse geometries as one or more inclined blades spinning about a hub and either propelling the fluid axially or radially with respect to the spin axis, a piston reciprocating within a sleeve or cylinder, a gear pair that rotates to separate on an intake side and mesh on a discharge side, a screw turning within a cylinder, a rotary vane, a diaphragm that moves to change the volume of a chamber, a collapsible tube pinched in a progressive manner by an external object or roller, gas bubbles rising in a liquid, gravity moving a liquid from a higher point of elevation to a lower elevation, ions driven by an electrical field, magnetic particles or objects driven by a magnetic field, and others. There are, quite plainly, many diverse geometries and constructions of fluid impellers.

The fluids that are pumped may be even more diverse, ranging from gases such as air or other gases moved by a fan, to low viscosity liquids such as water, and to viscous liquids such as oils and greases pumped within machinery. In the modern world, many different procedures and chemical compositions have been developed that improve a process, formulation, or operation, and rather than manually carrying out these procedures and delivering these compositions, in most cases a mechanized pump will do the work.

There are many different characteristics that can be measured to both define the pump and also determine the suitability of the pump for different applications. A few common characteristics are: flow rate, both with no outlet pressure and at various outlet pressures; inlet suction; maximum outlet pressure; horsepower or equivalent energy consumption; pump complexity; initial pump cost; required pump maintenance; and expected operating life usually measured as Mean Time Between Failure (MTBF). Other characteristics can be estimated or calculated therefrom as well, such as pump efficiency and annual operating cost. Pump efficiency is defined as the ratio of the kinetic power imparted on the fluid by the pump in relation to the power supplied to drive the pump, which can be determined from the energy consumed to generate a flow rate at a pressure head. Other exemplary metrics that may be less common but which may be important or critical for some applications include: compatibility with one or many different fluids, including but not limited to slurries, chemical compositions, and varying viscosities; consistency of output through varying pressure heads; conservation of fluid being pumped; mechanical shear; priming requirements; consistency of output flow rate and pressure; starting current and torque; suitable energy sources for driving the pump; and other factors.

For different applications, these characteristics are often times quite divergent from other applications. For exemplary purpose, a washing machine drain pump has very low pressure head required, typically only lifting the drain water from a few inches to a few feet, and will preferably be of simple construction, have low initial fabrication cost, will have a long MTBF, and will require little maintenance. However, the drain water may include somewhat corrosive compositions such as sodium hypochlorite (chlorine bleach) and powerful detergents that will quickly dissolve grease used in many pump seals. Further, there may be relatively large particles that pass through the washing machine drum along with the water, such as small pins, nails, screws, sand, and other solid objects, that must be pumped without consequential harm or stoppage of the pump. As has been known in the art of washing machines, a simple centrifugal or radial vane pump may be used to meet all of these objectives. However, such a pump will be unable to generate much in the way a greater pressure head, and consequently the output and pump efficiency will vary greatly with changes in pressure head.

In many fluid applications, such as chemical applications, one or more fluids must be mixed with one or more additional fluids to achieve a desired fluid mixture. Commonly, mixing one fluid with another fluid is performed by measuring out a quantity of a first fluid, measuring out a quantity of a second fluid, and combining the measured amounts in a container where the fluids are mixed together. This process is routinely performed by hand, and thus is subject to inaccuracies attributed to human error. Thus, the fluid mixture achieved may not in fact possess the precise desired proportions of the fluids. Additionally, as fluid mixtures are typically mixed in batches (i.e., discrete quantities of a fluid mixture), inconsistencies in the proportions of the mixed fluids from one batch to the next batch may be experienced.

Many artisans over the years have applied various technologies to improve various facets of pumps and to expand the applicability of pumps into industries and applications not previously well addressed. The following patents are incorporated herein by reference as exemplary of the state of the art in a variety of fields, various advances being made therein, and for the teachings and illustrations found therein which provide a foundation and backdrop for the technology of the present invention. The following list is not to be interpreted as determining relevance or analogy, but is instead in some instances provided solely to illustrate levels of skill in various fields to which the present invention pertains: U.S. Pat. No. 1,003,479 by Lucas, entitled "Pump valve"; U.S. Pat. No. 1,632,948 by Cardenas, entitled "Water pump"; U.S. Pat. No. 1,736,593 by Harm, entitled "Circulating device"; U.S. Pat. No. 1,827,811 by Derrick, entitled "Bearing for rotary pumps"; U.S. Pat. No. 1,970,251 by Rossman, entitled "Mechanical movement"; U.S. Pat. No. 2,002,783 by Long, entitled "Valve"; U.S. Pat. No. 2,054,009 by Thrush, entitled "Flexible coupling"; U.S. Pat. No. 2,367,135 by Moon et al, entitled "Tree spraying apparatus"; U.S. Pat. No. 2,739,537 by Sadler et al, entitled "Motor driven pump"; U.S. Pat. No. 2,881,338 by Banning, entitled "Variable speed alternating current motor"; U.S. Pat. No. 3,067,987 by Ballou et al, entitled "Two-component mixer"; U.S. Pat. No. 3,223,040 by Dinkelkamp, entitled "Two component pumping and proportioning system"; U.S. Pat. No. 3,338,171 by Conklin et al, entitled "Pneumatically operable diaphragm pumps"; U.S. Pat. No. 3,410,477 by Hartley, entitled "Vacuum pump"; U.S. Pat. No. 3,512,375 by Madarasz et al, entitled "Flexible coupling for shafts"; U.S. Pat. No. 3,653,784 by Leitermann et al, entitled "Proportionating feed pump"; U.S. Pat. No. 3,664,770 by Palmer, entitled "Diaphragm pumps"; U.S. Pat. No. 3,707,305 by Kinkelder, entitled "Automatic spray fluid control device"; U.S. Pat. No. 3,765,605 by Gusmer et al, entitled "Apparatus for ejecting a mixture of liquids"; U.S. Pat. No. 3,765,802 by Leitermann et al, entitled "Feed and proportioning pump"; U.S. Pat. No. 3,770,060 by Forsyth et al, entitled "Modular Firefighting unit"; U.S. Pat. No. 3,787,145 by Keyes et al, entitled "Mixing pump assembly"; U.S. Pat. No. 3,799,402 by Holmes et al, entitled "Liquid proportioning system"; U.S. Pat. No. 3,801,229 by Henderson, entitled "Combined motor and rotary fluid device"; U.S. Pat. No. 3,815,621 by Robinson, entitled "Proportioning pump"; U.S. Pat. No. 3,831,849 by Studinger, entitled "Mobile self contained pressure sprayer"; U.S. Pat. No. 3,894,690 by Hill, entitled "Horticulture spraying systems"; U.S. Pat. No. 3,910,497 by Manor, entitled "Hydraulic valve operator and remote control"; U.S. Pat. No. 3,963,038 by Jensen, entitled "Liquid proportioning pump"; U.S. Pat. No. 3,967,920 by Hill, entitled "Horticulture spraying systems"; U.S. Pat. No. 3,980,231 by Trondsen, entitled "Proportioning sprayer device"; U.S. Pat. No. 4,004,602 by Cordis et al, entitled "Self-metering dual proportioner"; U.S. Pat. No. 4,010,768 by Hechler IV, entitled "Two-stage jet pump proportioner"; U.S. Pat. No. 4,026,196 by Olofsson, entitled "Device for driving a pump piston"; U.S. Pat. No. 4,026,439 by Cocks, entitled "Precision fluid dispensing and mixing system"; U.S. Pat. No. 4,073,606 by Eller, entitled "Pumping installation"; U.S. Pat. No. 4,076,465 by Pauliukonis, entitled "Volumetric proportioning diluter"; U.S. Pat. No. 4,089,624 by Nichols et al, entitled "Controlled pumping system"; U.S. Pat. No. 4,119,113 by Meginniss III, entitled "Double-action proportioning pump"; U.S. Pat. No. 4,167,236 by Taubenmann, entitled "Apparatus for the feeding of liquid synthetic resin components"; U.S. Pat. No. 4,186,769 by Buyce, entitled "Liquid mixing and delivering aparatus"; U.S. Pat. No. 4,187,173 by Keefer, entitled "Reverse osmosis method and apparatus"; U.S. Pat. No. 4,191,309 by Alley et al, entitled "Product portioning in the continuous pumping of plastic materials"; U.S. Pat. No. 4,199,303 by Bairunas et al, entitled "Feeder for apparatus for ejecting a mixture of a plurality of liquids"; U.S. Pat. No. 4,200,426 by Linnert, entitled "Hermetic compressor assembly including torque reaction leaf spring means"; U.S. Pat. No. 4,234,007 by Titone et al, entitled "Automatic liquid flow control device"; U.S. Pat. No. 4,236,673 by Lake, entitled "Portable power operated chemical spray apparatus"; U.S. Pat. No. 4,243,523 by Pelmulder, entitled "Water purification process and system"; U.S. Pat. No. 4,273,261 by Krueger, entitled "Metering apparatus"; U.S. Pat. No. 4,278,205 by Binoche, entitled "Constant flow rate fluid supply device, particularly for a spray gun"; U.S. Pat. No. 4,288,326 by Keefer, entitled "Rotary shaft driven reverse osmosis method and apparatus"; U.S. Pat. No. 4,317,468 by Schwartz et al, entitled "Pressure relief valve"; U.S. Pat. No. 4,317,647 by Haeuser, entitled "Dosing system"; U.S. Pat. No. 4,341,327 by Zeitz, entitled "Digital proportional metering pumping system"; U.S. Pat. No. 4,350,179 by Bunn et al, entitled "Valve assembly with relief groove"; U.S. Pat. No. 4,360,323 by Anderson, entitled "Proportioning pumping system for dialysis machines"; U.S. Pat. No. 4,367,140 by Wilson, entitled "Reverse osmosis liquid purification apparatus"; U.S. Pat. No. 4,427,298 by Fahy et al, entitled "Method and system for accurately providing fluid blends"; U.S. Pat. No. 4,432,470 by Sopha, entitled "Multicomponent liquid mixing and dispensing assembly"; U.S. Pat. No. 4,434,056 by Keefer, entitled "Multi-cylinder reverse osmosis apparatus and method"; U.S. Pat. No. 4,436,493 by Credle, Jr., entitled "Self contained pump and reversing mechanism therefor"; U.S. Pat. No. 4,437,812 by Abu-Shumays et al, entitled "Single-pump multiple stroke proportioning for gradient elution liquid chromatography"; U.S. Pat. No. 4,440,314 by Vetter et al, entitled "Method and apparatus for the automatic dynamic dosing at least of one fluid component of a mixed fluid"; U.S. Pat. No. 4,445,470 by Chmielewski, entitled "Oil injection warning system"; U.S. Pat. No. 4,452,631 by Burow, Jr. et al, entitled "Urea herbicides"; U.S. Pat. No. 4,486,097 by Riley, entitled "Flow analysis"; U.S. Pat. No. 4,487,333 by Pounder et al, entitled "Fluid dispensing system"; U.S. Pat. No. 4,518,105 by Kuckens et al, entitled "Method of and device for dispensing viscous concentrates of variable viscosity in accurately metered quantities of variable volume"; U.S. Pat. No. 4,534,713 by Wanner, entitled "Pump apparatus"; U.S. Pat. No. 4,593,855 by Forsyth, entitled "Vehicle-mountable fire fighting apparatus"; U.S. Pat. No. 4,601,378 by Pierce et al, entitled "Supporting bracket for hydraulic pump and clutch"; U.S. Pat. No. 4,609,149 by Jessen, entitled "Injection gun system for lawn treatment"; U.S. Pat. No. 4,609,469 by Keoteklian, entitled "Method for treating plant effluent"; U.S. Pat. No. 4,629,568 by Ellis III, entitled "Fluid treatment system"; U.S. Pat. No. 4,645,599 by Fredkin, entitled "Filtration apparatus"; U.S. Pat. No. 4,648,854 by Redington, entitled "Variable speed drive"; U.S. Pat. No. 4,699,023 by Bajulaz, entitled "Mechanical reducer"; U.S. Pat. No. 4,705,461 by Clements, entitled "Two-component metering pump"; U.S. Pat. No. 4,708,674 by Matsumoto, entitled "Separate lubricating system for marine propulsion device"; U.S. Pat. No. 4,722,675 by Albarda, entitled "Piston proportioning pump"; U.S. Pat. No. 4,744,895 by Gales et al, entitled "Reverse osmosis water purifier"; U.S. Pat. No. 4,762,281 by Eberhardt, entitled "Drive arrangements for comminutor-pump assembly"; U.S. Pat. No. 4,773,993 by Yoda et al, entitled "Apparatus for purifying and dispensing water with stagnation preventing means"; U.S. Pat. No. 4,778,356 by Hicks, entitled "Diaphragm pump"; U.S. Pat. No. 4,778,597 by Bruzzi et al, entitled "Process for the separation and recovery of boron compounds from a geothermal brine"; U.S. Pat. No. 4,784,771 by Wathen et al, entitled "Method and apparatus for purifying fluids"; U.S. Pat. No. 4,789,100 by Senf, entitled "Multiple fluid pumping system"; U.S. Pat. No. 4,790,454 by Clark et al, entitled "Self-contained apparatus for admixing a plurality of liquids"; U.S. Pat. No. 4,804,474 by Blum, entitled "Energy efficient dialysis system"; U.S. Pat. No. 4,804,475 by Sirinyan et al, entitled "Metallized membrane systems"; U.S. Pat. No. 4,821,958 by Shaffer, entitled "Mobile pressure cleaning unit"; U.S. Pat. No. 4,850,812 by Voight, entitled "Integrated motor pump combination"; U.S. Pat. No. 4,887,559 by Hensel et al, entitled "Solenoid controlled oil injection system for two cycle engine"; U.S. Pat. No. 4,913,809 by Sawada et al, entitled "Concentrating apparatus with reverse osmosis membrane"; U.S. Pat. No. 4,921,133 by Roeser, entitled "Method and apparatus for precision pumping, ratioing and dispensing of work fluids"; U.S. Pat. No. 4,929,347 by Imai et al, entitled "Concentrating apparatus with reverse osmosis membrane"; U.S. Pat. No. 4,934,567 by Vahjen et al, entitled "Hybrid beverage mixing and dispensing system"; U.S. Pat. No. 4,941,596 by Marty et al, entitled "Mixing system for use with concentrated liquids"; U.S. Pat. No. 4,944,882 by Ray et al, entitled "Hybrid membrane separation systems"; U.S. Pat. No. 4,955,943 by Hensel et al, entitled "Metering pump controlled oil injection system for two cycle engine"; U.S. Pat. No. 4,999,209 by Gnekow, entitled "Low and non-alcoholic beverages produced by simultaneous double reverse osmosis"; U.S. Pat. No. 5,005,765 by Kistner, entitled "Method and apparatus for applying multicomponent materials"; U.S. Pat. No. 5,014,914 by Wallenas, entitled "Dose control apparatus for agricultural tube sprayers for spreading pesticides on fields and plants"; U.S. Pat. No. 5,027,978 by Roeser, entitled "Method and apparatus for precision pumping, ratioing, and dispensing of work fluid(s)"; U.S. Pat. No. 5,055,008 by Daniels et al, entitled "Proportionating pump for liquid additive metering"; U.S. Pat. No. 5,057,212 by Burrows, entitled "Water conductivity monitor and circuit with extended operating life"; U.S. Pat. No. 5,058,768 by Lichfield, entitled "Methods and apparatus for dispensing plural fluids in a precise proportion"; U.S. Pat. No. 5,089,124 by Mahar et al, entitled "Gradient generation control for large scale liquid chromatography"; U.S. Pat. No. 5,100,058 by Wei, entitled "Self-contained cleaning system for motor vehicles"; U.S. Pat. No. 5,100,699 by Roeser, entitled "Method and apparatus for precision pumping, ratioing, and dispensing of work fluid(s)"; U.S. Pat. No. 5,102,312 by Harvey, entitled "Pump head"; U.S. Pat. No. 5,108,273 by Romanyszyn, entitled "Helical metering pump having different sized rotors"; U.S. Pat. No. 5,114,241 by Morrison, entitled "Device for insulating motor stators"; U.S. Pat. No. 5,118,008 by Williams, entitled "Programmable additive controller"; U.S. Pat. No. 5,133,483 by Buckles, entitled "Metering system"; U.S. Pat. No. 5,170,912 by Du, entitled "Proportioning pump"; U.S. Pat. No. 5,173,039 by Cook, entitled "Double acting simplex plunger pump"; U.S. Pat. No. 5,180,108 by Miyamoto, entitled "Truck with a power spray device"; U.S. Pat. No. 5,183,396 by Cook et al, entitled "Double acting simplex plunger pump"; U.S. Pat. No. 5,184,941 by King et al, entitled "Mounting support for motor-pump unit"; U.S. Pat. No. 5,192,000 by Wandrick et al, entitled "Beverage dispenser with automatic ratio control"; U.S. Pat. No. 5,207,916 by Goheen et al, entitled "Reverse osmosis system"; U.S. Pat. No. 5,221,192 by Heflin et al, entitled "Elastomeric compressor stud mount"; U.S. Pat. No. 5,228,594 by Aslin, entitled "Metered liquid dispensing system"; U.S. Pat. No. 5,235,944 by Adachi, entitled "Engine lubricating system"; U.S. Pat. No. 5,253,981 by Yang et al, entitled "Multichannel pump apparatus with microflow rate capability"; U.S. Pat. No. 5,255,819 by Peckels, entitled "Method and apparatus for manual dispensing from discrete vessels with electronic system control and dispensing data generation on each vessel, data transmission by radio or interrogator, and remote data recording"; U.S. Pat. No. 5,287,833 by Yashiro, entitled "Lubricating oil supplying system for two cycle engine"; U.S. Pat. No. 5,297,511 by Suzuki, entitled "Lubricating system for engine"; U.S. Pat. No. 5,303,866 by Hawks, entitled "Integrated modular spraying system"; U.S. Pat. No. 5,332,123 by Farber et al, entitled "Device for the measured dispensing of liquids out of a storage container and synchronous mixing with a diluent"; U.S. Pat. No. 5,344,291 by Antkowiak, entitled "Motor pump power end interconnect"; U.S. Pat. No. 5,354,182 by Niemiec et al, entitled "Unitary electric-motor/hydraulic-pump assembly with noise reduction features"; U.S. Pat. No. 5,355,851 by Kamiya, entitled "Lubricating oil supplying system for two cycle engine"; U.S. Pat. No. 5,368,059 by Box et al, entitled "Plural component controller"; U.S. Pat. No. 5,370,269 by Bernosky et al, entitled "Process and apparatus for precise volumetric diluting/mixing of chemicals"; U.S. Pat. No. 5,383,605 by Teague, entitled "Radio controlled spraying device"; U.S. Pat. No. 5,390,635 by Kidera et al, entitled "Lubricating oil supplying system for engine"; U.S. Pat. No. 5,403,490 by Desai, entitled "Process and apparatus for removing solutes from solutions"; U.S. Pat. No. 5,433,349 by Romanyszyn, entitled "Mixing and flushing device for juice dispensing tower"; U.S. Pat. No. 5,439,592 by Bellos et al, entitled "Method for removal of water soluble organics from oil process water"; U.S. Pat. No. 5,490,939 by Gerigk et al, entitled "Process for reconcentrating overspray from one-component coating compositions"; U.S. Pat. No. 5,494,414 by Steinhart et al, entitled "Vertical shaft pressure washer coupling assembly"; U.S. Pat. No. 5,511,524 by Kidera et al, entitled "Lubricating oil supplying system for engine"; U.S. Pat. No. 5,538,641 by Getty et al, entitled "Process for recycling laden fluids"; U.S. Pat. No. 5,542,578 by Buckles, entitled "Dispensing gun for ratio sensitive two-part material"; U.S. Pat. No. 5,558,435 by Marjo, entitled "System for mixing liquids"; U.S. Pat. No. 5,630,383 by Kidera et al, entitled "Lubricating oil supplying system for engine"; U.S. Pat. No. 5,636,648 by O'Brien et al, entitled "Mobile rotator jet sewer cleaner"; U.S. Pat. No. 5,647,973 by Desaulniers, entitled "Reverse osmosis filtration system with concentrate recycling controlled by upstream conductivity"; U.S. Pat. No. 5,707,219 by Powers, entitled "Diaphragm pump"; U.S. Pat. No. 5,779,449 by Klein, entitled "Separable, multipartite impeller assembly for centrifugal pumps"; U.S. Pat. No. 5,785,504 by Cote, entitled "Pump with separate pumping stages for pumping a plurality of liquids"; U.S. Pat. No. 5,823,752 by Hoenisch et al, entitled "Adapter for mechanically coupling a pump and a prime mover"; U.S. Pat. No. 5,829,401 by Masuda, entitled "Lubrication system for two-cycle engine"; U.S. Pat. No. 5,855,626 by Wiegner et al, entitled "Method for mixing and dispensing oxygen degradable hair dye concentrates"; U.S. Pat. No. 5,862,947 by Wiegner et al, entitled "Hair dye color selection system and method"; U.S. Pat. No. 5,878,708 by Ruman, entitled "Oil management system for a fuel injected engine"; U.S. Pat. No. 5,879,137 by Yie, entitled "Method and apparatus for pressurizing fluids"; U.S. Pat. No. 5,908,183 by Fury, entitled "Precision power coupling housing"; U.S. Pat. No. 5,975,152 by Kluge, entitled "Fluid container filling apparatus"; U.S. Pat. No. 5,975,863 by Mazzucato, entitled "High pressure water pump system"; U.S. Pat. No. 6,012,608 by Ridenour, entitled "Storage and metering system for supersaturated feed supplements"; U.S. Pat. No. 6,034,465 by McKee et al, entitled "Pump driven by brushless motor"; U.S. Pat. No. 6,050,756 by Buchholz et al, entitled "Method of cooling and lubricating a tool and/or workpiece and a working spindle for carrying out the method"; U.S. Pat. No. 6,055,831 by Barbe, entitled "Pressure sensor control of chemical delivery system"; U.S. Pat. No. 6,056,515 by Cuneo, entitled "Hydrocleaning machine with pump mounting closure lid"; U.S. Pat. No. 6,070,764 by Cline et al, entitled "Apparatus for dispensing liquids and solids"; U.S. Pat. No. 6,074,551 by Jones et al, entitled "Automatic cleaning system for a reverse osmosis unit in a high purity water treatment system"; U.S. Pat. No. 6,098,646 by Hennemann et al, entitled "Dispensing system with multi-port valve for distributing use dilution to a plurality of utilization points and position sensor for use thereon"; U.S. Pat. No. 6,110,375 by Bacchus et al, entitled "Process for purifying water"; U.S. Pat. No. 6,113,797 by Al-Samadi, entitled "High water recovery membrane purification process"; U.S. Pat. No. 6,120,682 by Cook, entitled "Portable pump-type reverse osmosis apparatus"; U.S. Pat. No. 6,139,748 by Ericson et al, entitled "Method and device for monitoring an infusion pump"; U.S. Pat. No. 6,162,023 by Newman, entitled "Reciprocating cam actuation mechanism for a pump"; U.S. Pat. No. 6,164,560 by Lehrke et al, entitled "Lawn applicator module and control system therefor"; U.S. Pat. No. 6,186,193 by Phallen et al, entitled "Continuous liquid stream digital blending system"; U.S. Pat. No. 6,190,556 by Uhlinger, entitled "Desalination method and apparatus utilizing nanofiltration and reverse osmosis membranes"; U.S. Pat. No. 6,247,838 by Pozniak et al, entitled "Method for producing a liquid mixture having a predetermined concentration of a specified component"; U.S. Pat. No. 6,254,779 by Jeffery et al, entitled "Treatment of effluent streams containing organic acids"; U.S. Pat. No. 6,257,843 by Cook et al, entitled "Self-aligning double-acting simplex plunger pump"; U.S. Pat. No. 6,284,171 by Nonomura et al, entitled "Blow molding process"; U.S. Pat. No. 6,293,756 by Andersson, entitled "Pump"; U.S. Pat. No. 6,305,169 by Mallof, entitled "Motor assisted turbocharger"; U.S. Pat. No. 6,328,388 by Mohr et al, entitled "Brake actuation unit"; U.S. Pat. No. 6,333,018 by Bianchi et al, entitled "Process for the industrial production of high purity hydrogen peroxide"; U.S. Pat. No. 6,336,794 by Kim, entitled "Rotary compressor assembly with improved vibration suppression"; U.S. Pat. No. 6,374,781 by Kato, entitled "Oil injection lubrication system for two-cycle engines"; U.S. Pat. No. 6,386,396 by Strecker, entitled "Mixing rotary positive displacement pump for micro dispensing"; U.S. Pat. No. 6,398,521 by Yorulmazoglu, entitled "Adapter for motor and fluid pump"; U.S. Pat. No. 6,409,375 by Knight, entitled "Precision injected liquid chemical mixing apparatus"; U.S. Pat. No. 6,422,183 by Kato, entitled "Oil injection lubrication system and methods for two-cycle engines"; U.S. Pat. No. 6,439,860 by Greer, entitled "Chambered vane impeller molten metal pump"; U.S. Pat. No. 6,464,107 by Brugger, entitled "Dosage dispenser"; U.S. Pat. No. 6,491,494 by Beckenbach et al, entitled "Direct drive water pump"; U.S. Pat. No. 6,527,524 by Cook, entitled "Double acting simplex plunger pump with bi-directional valves"; U.S. Pat. No. 6,554,577 by Park et al, entitled "Apparatus and method for controlling operation of linear compressor using pattern recognition"; U.S. Pat. No. 6,568,559 by Miller et al, entitled "Termite control system with multi-fluid proportion metering and batch signal metering"; U.S. Pat. No. 6,607,668 by Rela, entitled "Water purifier"; U.S. Pat. No. 6,696,298 by Cook et al, entitled "Multi-channel reagent dispensing apparatus"; U.S. Pat. No. 6,735,945 by Hall et al, entitled "Electric turbocharging system"; U.S. Pat. No. 6,739,845 by Woollenweber, entitled "Compact turbocharger"; U.S. Pat. No. 6,742,765 by Takano et al, entitled "Operating device and valve system"; U.S. Pat. No. 6,817,486 by Yang, entitled "Photoresist supply apparatus capable of controlling flow length of photoresist and method of supplying photoresist using the same"; U.S. Pat. No. 6,824,364 by Ross et al, entitled "Master/slave pump assembly employing diaphragm pump"; U.S. Pat. No. 6,841,076 by Wobben, entitled "Method and device for desalting water"; U.S. Pat. No. 6,857,543 by Kvam et al, entitled "Low volume dispense unit and method of using"; U.S. Pat. No. 6,863,036 by Kato, entitled "Lubrication system for two-cycle engine"; U.S. Pat. No. 6,893,569 by Zelechonok, entitled "Method and apparatus for high pressure liquid chromatography"; U.S. Pat. No. 6,896,152 by Pittman et al, entitled "Electronic plural component proportioner"; U.S. Pat. No. 6,974,052 by d'Hond et al, entitled "Dosing device adapted for dispensing a concentrate from a holder in a metered manner"; U.S. Pat. No. 6,997,683 by Allington et al, entitled "High pressure reciprocating pump and control of the same"; U.S. Pat. No. 7,050,886 by Oberg et al, entitled "Chemical dispensing system for a portable concrete plant"; U.S. Pat. No. 7,063,785 by Hiraku et al, entitled "Pump for liquid chromatography"; U.S. Pat. No. 7,066,353 by Hammonds, entitled "Fluid powered additive injection system"; U.S. Pat. No. 7,067,061 by Bosetto et al, entitled "Method and a device for preparing a medical liquid"; U.S. Pat. No. 7,141,161 by Ito, entitled "Gradient pump apparatus"; U.S. Pat. No. 7,147,827 by Balisky, entitled "Chemical mixing, replenishment, and waste management system"; U.S. Pat. No. 7,207,260 by Thierry et al, entitled "Reciprocating hydraulic machine, especially a motor, and dosing apparatus comprising such a motor"; U.S. Pat. No. 7,823,323 by Su, entitled "Remote monitoring system for detecting termites"; U.S. Pat. No. 9,316,216 by Cook et al, entitled "Proportioning Pump, Control Systems and Applicator Apparatus"; U.S. Pat. No. RE 18,303 by Harm, entitled "Circulating device"; U.S. Pat. No. RE 32,144 by Keefer, entitled "Reverse osmosis method and apparatus"; U.S. Pat. No. RE 33,135 by Wanner, Sr., deceased et al, entitled "Pump apparatus"; 2002/0157413 by Iwanami et al, entitled "Compressor driven selectively by first and second drive sources"; 2003/0103850 by Szulczewski, entitled "Axial piston pump/motor with clutch and through shaft"; 2003/0147755 by Carter, III et al, entitled "Dual drive for hydraulic pump and air boost compressor"; 2003/0160525 by Kimberlin et al, entitled "Motor pump with balanced motor rotor"; 2004/0033144 by Rush, entitled "Decoupling mechanism for hydraulic pump/motor assembly"; 2004/0136833 by Allington et al, entitled "High pressure reciprocating pump and control fo the same"; 2004/0175278 by Dexter et al, entitled "Pressure washer having oilless high pressure pump"; 2004/0244372 by Leavesley, entitled "Turbocharger apparatus"; 2004/0247461 by Pflueger et al, entitled "Two stage electrically powered compressor"; 2004/0265144 by Fukanuma et al, entitled "Hybrid compressor"; 2005/0019187 by Whitworth et al, entitled "Internal screw positive rod displacement metering pump"; 2005/0254970 by Mayer et al, entitled "Quick connect pump to pump mount and drive arrangement"; 2006/0228233 by Cook, entitled "Pump and motor assembly"; 2007/0029255 by D'Amato et al, entitled "Desalination system powered by renewable energy source and methods related thereto"; 2008/0296224 by Cook et al, entitled "Reverse osmosis pump system"; 2009/0068034 by Cook, entitled "Pumping system with precise ratio output"; and 2010/0127410 by Drager, entitled "Method and device for the metered release of irritants".

A challenging application for a pump is the precise or predictable delivery of a volume of fluid in a given time. Piston-type pumps are known to provide a number of advantages over pumps of other construction. Among them is the ability to more precisely or predictably deliver a consistent volume, even with widely varying inlet and outlet pressures. This is because a piston reciprocating in a cylinder creates what is referred to as a positive displacement that is much more independent of inlet and outlet pressure than many other pump types.

There are several challenges with prior art piston pumps. One of these is the inherent pulsations that are created by the movement of the pistons. A typical prior art pump may employ a rotary shaft driven from a motive power source such as an engine or motor, such as might for exemplary purposes be electrically or gasoline powered. The pump may typically have either one or two pistons that reciprocate within a corresponding number of cylinders. Even in the case of a dual piston pump, the moment where one piston has just finished the expelling travel and the other piston is about to begin expelling, there is no driving force on the liquid being expelled. Since there will likely be a hose or pipe of indeterminate length at the outlet of the pump, and since the mass of the liquid within that pipe or outlet has momentum created by the expulsion from the pump, during this moment there is no fluid being expelled from the pump and the momentum of the liquid must be broken. This start and stop of the expulsion leads to a certain amount of pulsation in a small pump of low flow rate. However, when the flow rate is substantially increased, the pulsations increase and become hammering and vibration. As is well established, in most mechanical systems extreme vibrations are detrimental and can lead to early failure.

In addition, as the flow rate is increased, there will also be a concomitant increase in the load imposed upon bearings that support the rotary shaft. This leads to elevated temperature within the bearing, which is also known to be detrimental, particularly when operated in an already hot environment.

The increased flow rate and pulsations not only increase the load upon the bearings, but also increase the load and also potentially the wear of the valves, pistons, cylinders, and seals. In consideration thereof, various artisans have developed multi-piston pumps having three or more pistons that are radially arranged about a rotary drive shaft. These pumps are configured in some instances to resemble well known internal combustion and steam engines, including connecting rods between a central shaft or drive wheel. Exemplary U.S. patents and published applications, the teachings which are incorporated herein by reference, include: U.S. Pat. No. 4,645,428 by Arregui et al, entitled "Radial piston pump"; and 2009/0074591 by Courier, entitled "High pressure radial pump". Unfortunately, this construction requires a large number of bearings and couplings that drastically increase the initial pump cost. These additional parts also tend to decrease the average reliability of such pumps, reflected in a shorter Mean Time Between Failure (MTBF). In order to improve the reliability of such pumps, and like prior art steam engines and internal combustion engines, the internal components are often required to be either immersed in a lubricant such as an oil bath, or sprayed or splashed with lubricant on a relatively continuous basis. Unfortunately, at any pressure there will be some leakage past the seal between the piston and cylinder, and this leaked fluid may migrate to the region of the connecting rods and bearings and can cause early failure. This can be particularly disadvantageous in some applications, particularly where non-lubricant fluids are being pumped at very increased pumping pressures.

Other artisans have avoided the need for connecting rods through the use of cams defining an eccentric cam surface about the rotary shaft to drive the pistons. In some of these instances, the artisans have relied upon return springs to keep the pistons in contact with the cam. Exemplary U.S. patents, the teachings which are incorporated herein by reference, include: U.S. Pat. No. 935,655 by Haire, entitled "Gaseous fluid compressor"; U.S. Pat. No. 2,461,121 by Markham, entitled "Fluid pump"; U.S. Pat. No. 2,801,596 by Sewell, entitled "Multi-cylinder pump"; U.S. Pat. No. 5,032,065 by Yamamuro et al, entitled "Radial piston pump"; U.S. Pat. No. 5,167,493 by Kobari, entitled "Positive-displacement type pump system"; U.S. Pat. No. 5,382,140 by Eisenbacher et al, entitled "Radial-piston pump"; U.S. Pat. No. 5,383,770 by Hisahara, entitled "Radial piston pump with vent in hollow piston"; and U.S. Pat. No. 6,162,022 by Anderson et al, entitled "Hydraulic system having a variable delivery pump". Unfortunately, the return springs must be sufficiently powerful to drive the pistons into contact with the cam, regardless of the state of the fluid flow. In other words, if a viscous liquid is being pumped, and the spring is acting to move the fluid into the piston cylinder, then the return spring must be strong enough to overcome the thick liquid and still draw the liquid in. Yet, with a thin or much less viscous liquid, this must be accomplished without causing the piston to bounce. Furthermore, any separation between the piston and cam will also lead to subsequent impact, either in the form of taps or rattling, or in extreme cases in the form of severe hammering. Clearly, none of these are desirable. The spring itself is also being cycled rather violently, storing substantial energy when the piston is moving in a first direction and then releasing it when the piston is moving in the opposite direction. This energy storage and release leads to both substantial heating within the spring and also to potential work hardening or molecular reorientation, which will lead to spring breakage and failure. Finally, any separation or failure of the piston to fill the cylinder on the intake stroke or to empty the cylinder on the outlet stroke will result in a decrease in pump flow rate or output volume. Such a decrease in output defeats the precise volume displacement with each piston stroke that is otherwise a primary benefit of a positive displacement pump such as a piston pump.

Other artisans have overcome this deficiency of spring return using other mechanisms. Exemplary U.S. patents, the teachings which are incorporated herein by reference, include: U.S. Pat. No. 4,690,620 by Eickmann, entitled "Variable radial piston pump"; and U.S. Pat. No. 5,613,839 by Buckley, entitled "Variable rate pump". Each of these patents requires an inlet pressure greater than atmosphere to drive the piston on the inlet stroke, and then uses the cam to drive the piston in the opposite direction on the outlet stroke. In other words, there must be a pump in the fluid flow path preceding these pumps to provide the fluid pressure required to fill the cylinder on the inlet stroke. While there are certain applications where this can be of great benefit, the applications for such a pump are much more restricted and of course more expensive, owing to the need for two pumps instead of one.

A few artisans have heretofore recognized the limitations of the piston return springs or need for pressurized inlet fluid. Exemplary U.S. patents, the teachings which are incorporated herein by reference, include: U.S. Pat. No. 759,828 by Olney, entitled "Engine"; U.S. Pat. No. 5,030,065 by Baumann, entitled "Reciprocating compressor"; and U.S. Pat. No. 8,333,572 by Hsieh, entitled "Pump". These patents describe various yokes that are designed to positively reciprocate the pistons. As already noted herein above, the yokes can thereby be used to simultaneously increase the reliability and life of the pump, improve the operation of the pump with diverse viscosities of fluids, maintain high precision in pump volume, and also avoid the need for a second inlet pump. In addition to these multi-piston pumps, there are a number of patents for inventions developed by Cook and Cook et al and owned by the present assignee referenced herein above with regard to single or dual piston pumps that illustrate yokes of similar purpose and function.

In spite of the many advantages of these yokes and the existence of the aforementioned multi-cylinder piston pumps, the many characteristics of pumps described herein above have continued to be contrary in the marketplace. As is very apparent from a review of the multi-piston pumps described herein above, the complexity of these prior art pumps makes the initial pump cost very high, and many such pumps are often also associated with a shorter expected life as measured by MTBF.

As may be apparent, in spite of the enormous advancements and substantial research and development that has been conducted, there still remains a need for a positive displacement pump that is capable of precise or predictable delivery of a volume of fluid in a given time independent of reasonable inlet and outlet pressures pump, that is also capable of increased volume pumping while reducing the associated vibration of the prior art, and which is also better able to withstand extremes of temperature and load.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is a pump body having an intake manifold with internal inlet conduits, an outlet manifold having internal outlet conduits, and a plurality of heads affixed to the intake and outlet manifolds. Captured between each head and the intake manifold are a plurality of one-way inlet valves and seals. Captured between each head and the outlet manifold are a plurality of one-way outlet valves and seals.

In a second manifestation, the invention is a pump having a fluid intake manifold with fluid internal inlet conduits and a first rotary drive shaft bearing affixed thereto, an outlet manifold having internal outlet conduits and a second rotary drive shaft bearing affixed thereto, a working fluid operatively flowing through the inlet conduits and outlet conduits and thereby cooling the first and second rotary drive shaft bearings.

In a third manifestation, the invention is a pump head machined from four bores open on a first end and closed internally within the pump head on a second end distal to the first end, a first bore defining a radial inlet bore, a second bore defining a radial outlet bore, a third bore defining a piston cylinder, and a fourth bore passing through each of said first three bores and defining both a longitudinal inlet bore and a longitudinal outlet bore.

OBJECTS OF THE INVENTION

Exemplary embodiments of the present invention solve inadequacies of the prior art by providing a positive displacement reciprocating multi-cylinder pump having a cam, bearing(s), and yokes that cooperatively and positively reciprocate the pistons. The fluid flow paths are configured to provide intrinsic cooling of the bearings through specially configured fluid flow paths at distal ends of the pump. An intentional head geometry that may be readily machined captures valves and provides essential fluid flow paths about the cylinders.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide a pump that can provide precise or predictable delivery of a volume of fluid in a given time, independent of reasonable ranges of inlet and outlet pressures and viscosity of fluid. A second object of the invention is to provide a pump that can provide increased volume pumping while reducing the associated vibration and pressure pulsation during pump operation. Another object of the present invention is to provide a pump that is also better able to withstand extremes of temperature and load. A further object of the invention is to provide a pump that requires a minimum of components, and most preferably components that can easily be machined or produced in a low cost manner, and that further can be readily assembled without special tools. Yet another object of the present invention is to provide a pump that may use sealed bearings within an atmospheric chamber, thereby reducing the need for special lubricant sprays or immersion baths and allowing any leakage to be either released to atmosphere or if so desired, collected and removed without harming bearings or other internal components.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

In a preferred embodiment of the invention illustrated in the Figures, a compact pump 10 having reduced vibration and reduced thermal degradation is comprised of a motor coupler 200 and pump body 300. Motor coupler 200 may, for exemplary and non-limiting purposes, include a coupling body that may provide a motor connection sleeve that might incorporate any suitable apparatus that will conveniently or appropriately couple to a motor shaft. Exemplary are paired geometries, such as but not limited to a slotted sleeve so as to receive a keyed shaft and associated key, or a shaft having one or more flats that engage with features in the surrounding sleeve.

Figure 5:
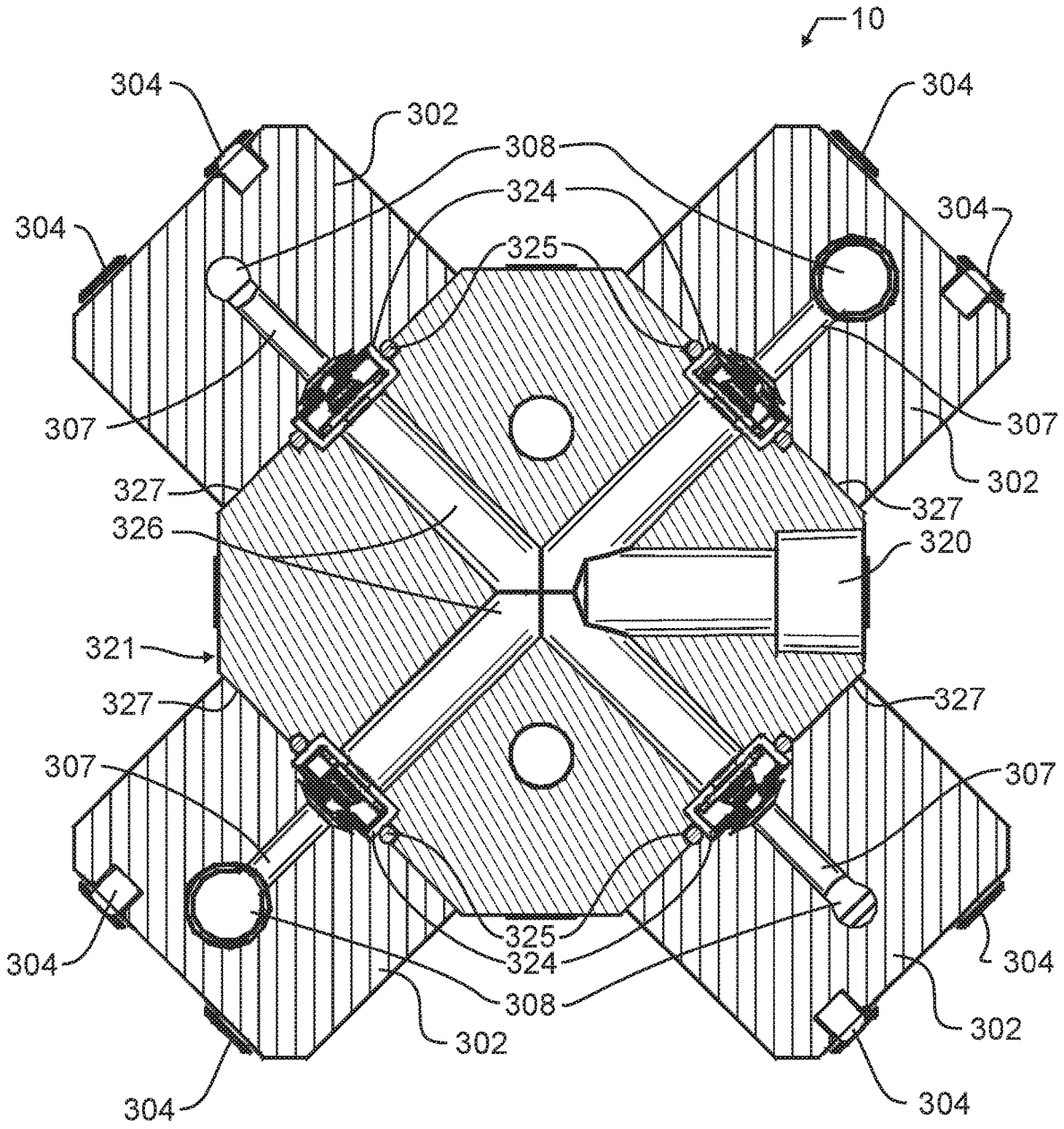
FIG. 5 illustrates the preferred embodiment compact pump of FIG. 1 from sectional view taken along line 5' of FIG. 1.

Within pump body 300, adjacent a first end there is provided an intake manifold 321 illustrated in FIG. 5 having an inlet port 320 and four inlet conduits 326 in fluid communication therewith. Inlet port 320 will also operatively be in fluid communication to any suitable source fluid which is to be pumped as is known in the art. For exemplary and non-limiting purposes, and while not illustrated, an inlet hose may be threaded into or otherwise coupled with inlet port 320.

In preferred embodiment compact pump 10, intake manifold 321 is formed from a solid block of aluminum or aluminum alloy which is drilled from the exterior to form inlet port 320 and each of the four inlet conduits 326. The drilling or other boring process will leave visible lines in the cross-sectional view of FIG. 5 at the intersection of inlet port 320 and each of the four inlet conduits 326, but it will be understood that these all are connected together to allow the flow of fluid in a relatively unrestricted manner at the intersection. While aluminum and alloys thereof are most preferred for the composition of intake manifold 321, owing to the good heat conductivity, easy machinability, relatively low cost, and high strength to weight ratio of aluminum and aluminum alloys, other suitable materials may be substituted in alternative embodiments.

Each of the four inlet conduits 326 are coupled distally to inlet port 320 with one-way inlet valves 324. In preferred embodiment compact pump 10, a slightly larger diameter bore may be provided adjacent to the surface of intake manifold 321 to partially receive valves 324. In addition, an even shallower and larger diameter bore may further be provided to receive o-ring seals 325.

As also visible from FIG. 5, intake manifold 321 has a cross-sectional geometry with an octagonal outer perimeter. While the exact geometry is not critical to the invention, the provision of four major flat surfaces 327 is most preferred. A head 302 is attached to each of these flat surfaces 327 using suitable fasteners, for exemplary and non-limiting purpose socket-head bolts 304 illustrated.

Each head 302 is most preferably fabricated from the same material and dimension as every other. As with intake manifold 321, in preferred embodiment compact pump 10 the four heads 302 will most preferably be fabricated from a solid block or billet of aluminum or aluminum alloy which is drilled from the exterior to form a set of four radial inlet bores 307 and a set of four radial outlet bores 309 therein. Radial inlet bores 307 are aligned with and in fluid communication with one-way inlet valves 324.

O-ring seals 325 prevent leakage in the fluid path between intake manifold 321 and each of the four heads 302. These o-ring seals 325 may in one embodiment, just prior to installing the heads 302 and tightening socket-head bolts 304 at the time of installation, be conveniently wrapped around the associated inlet valve 324. The elasticity of the o-rings will hold them in place, simplifying installation. Other installation techniques and sequences may be used in other alternative embodiments. As may be apparent then, the installation of a head 302 onto intake manifold 321 will simultaneously capture and secure the associated one-way inlet valves 324 and o-ring seals 325, again reducing the number of installation steps and thereby simplifying installation.

Fluid passes from inlet port 320 through each of the four inlet conduits 326, through the associated one-way inlet valve 324 into radial inlet bores 307. From there, the fluid passes into the associated cylinder 312, which has also been drilled from the exterior of each head 302 in a direction radial to rotary drive shaft 220. The fluid is prevented from escaping from cylinder 312 by a combination of the associated piston 345-348 and piston seal ring 349. In preferred embodiment compact pump 10, the cylinder wall is bored at two diameters, with the portion more adjacent to rotary drive shaft 220 having a slightly larger diameter to accommodate piston seal ring 349. Nevertheless, other methods of sealing the piston and cylinder wall are known in the prior art incorporated herein above by reference and in the industry, and these other methods will be suitably used in alternative embodiments.

Figure 1:
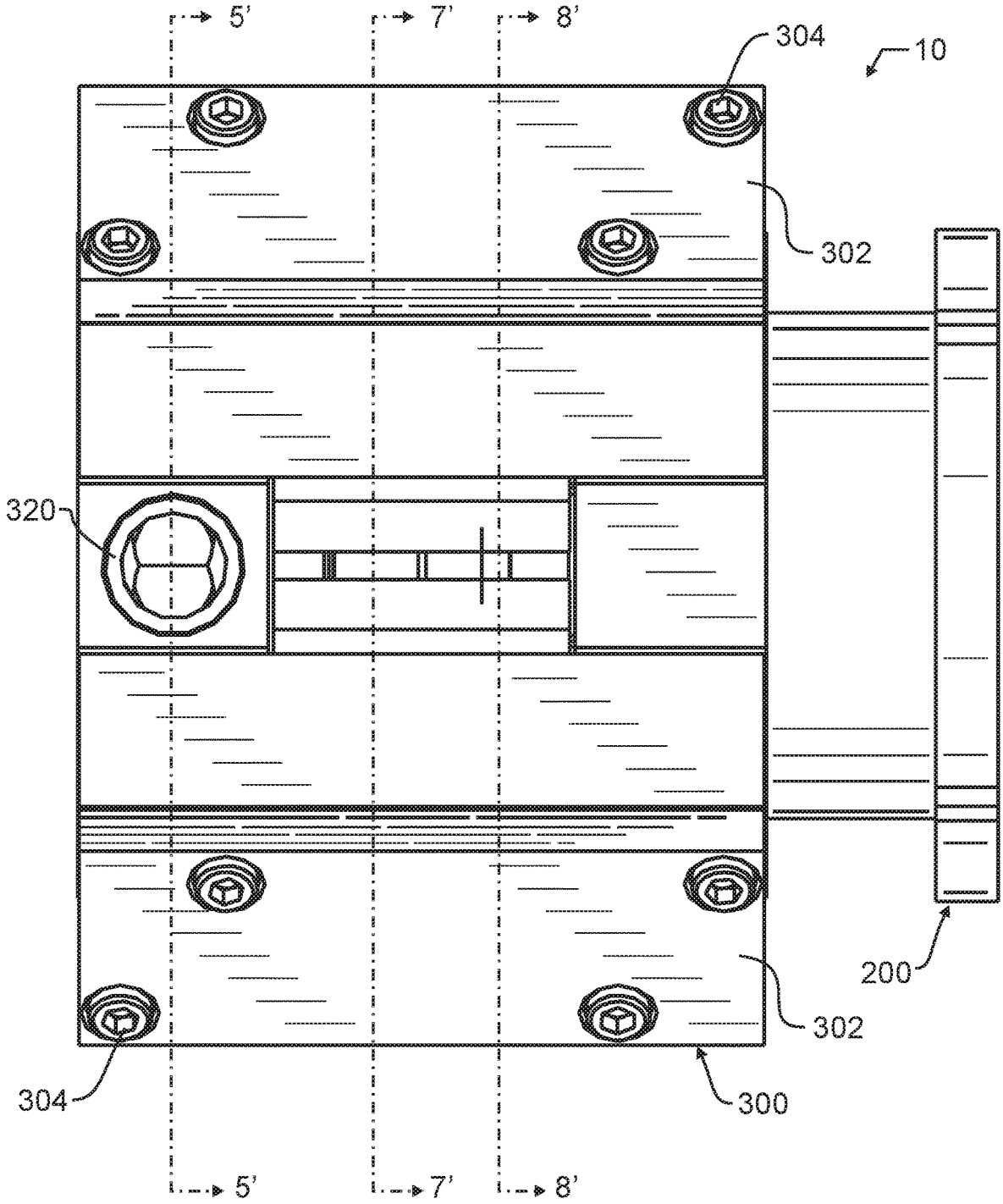
FIG. 1 illustrates a preferred embodiment compact pump with reduced vibration and reduced thermal degradation designed in accord with the teachings of the present invention from a front elevational view.
Figure 2:
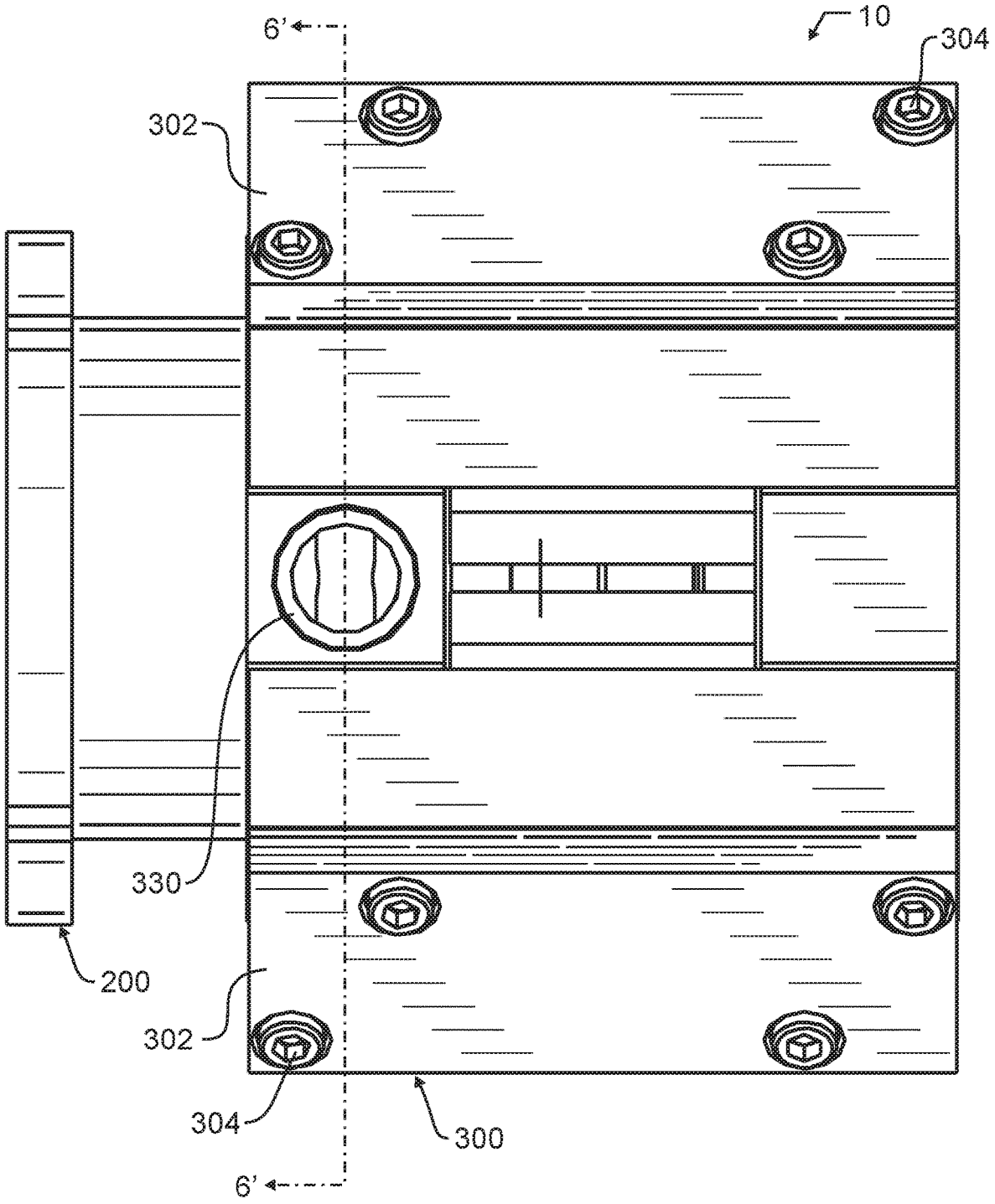
FIG. 2 illustrates the preferred embodiment compact pump of FIG. 1 from rear view.
Figure 3:
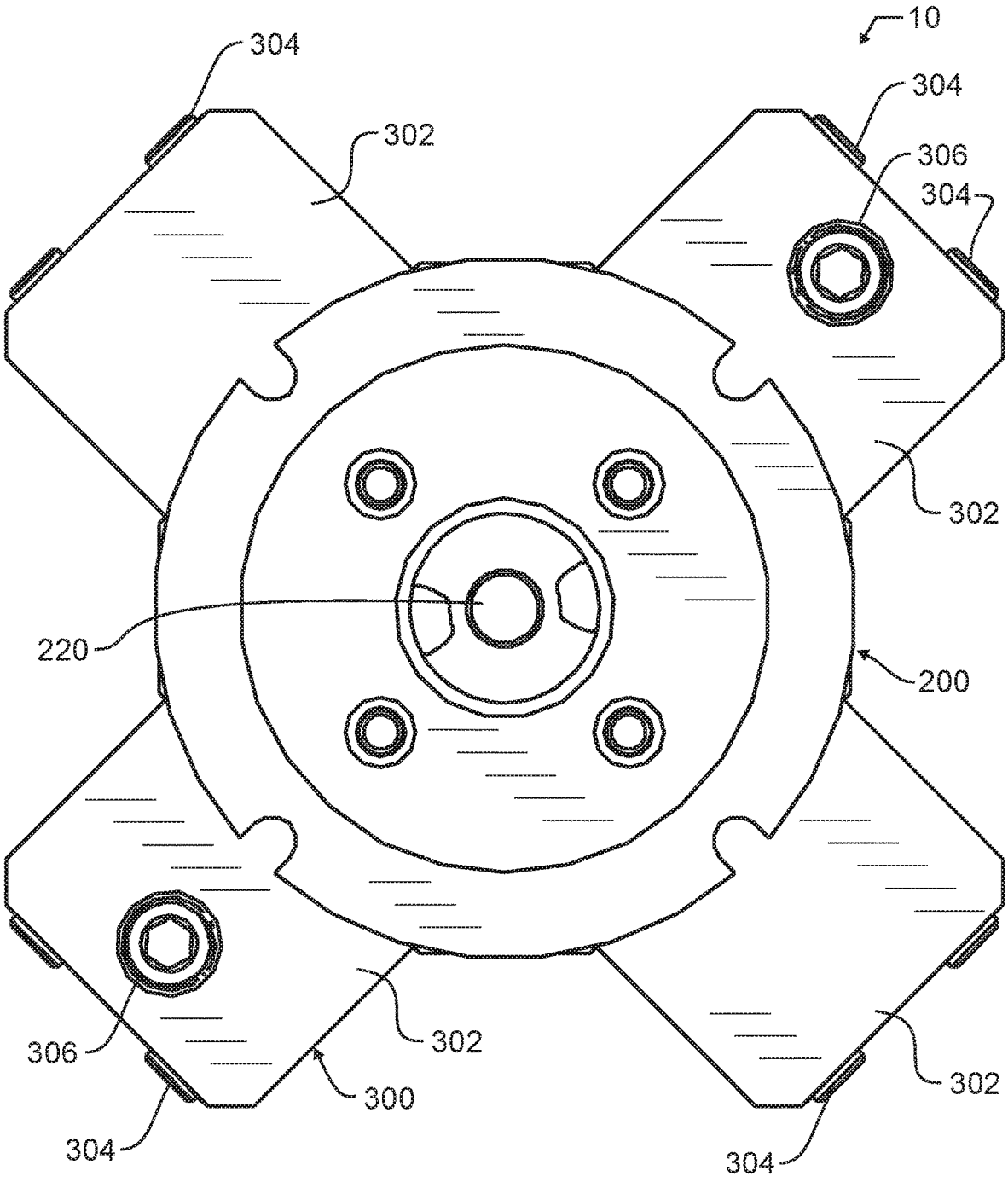
FIG. 3 illustrates the preferred embodiment compact pump of FIG. 1 from right side view.
Figure 4:
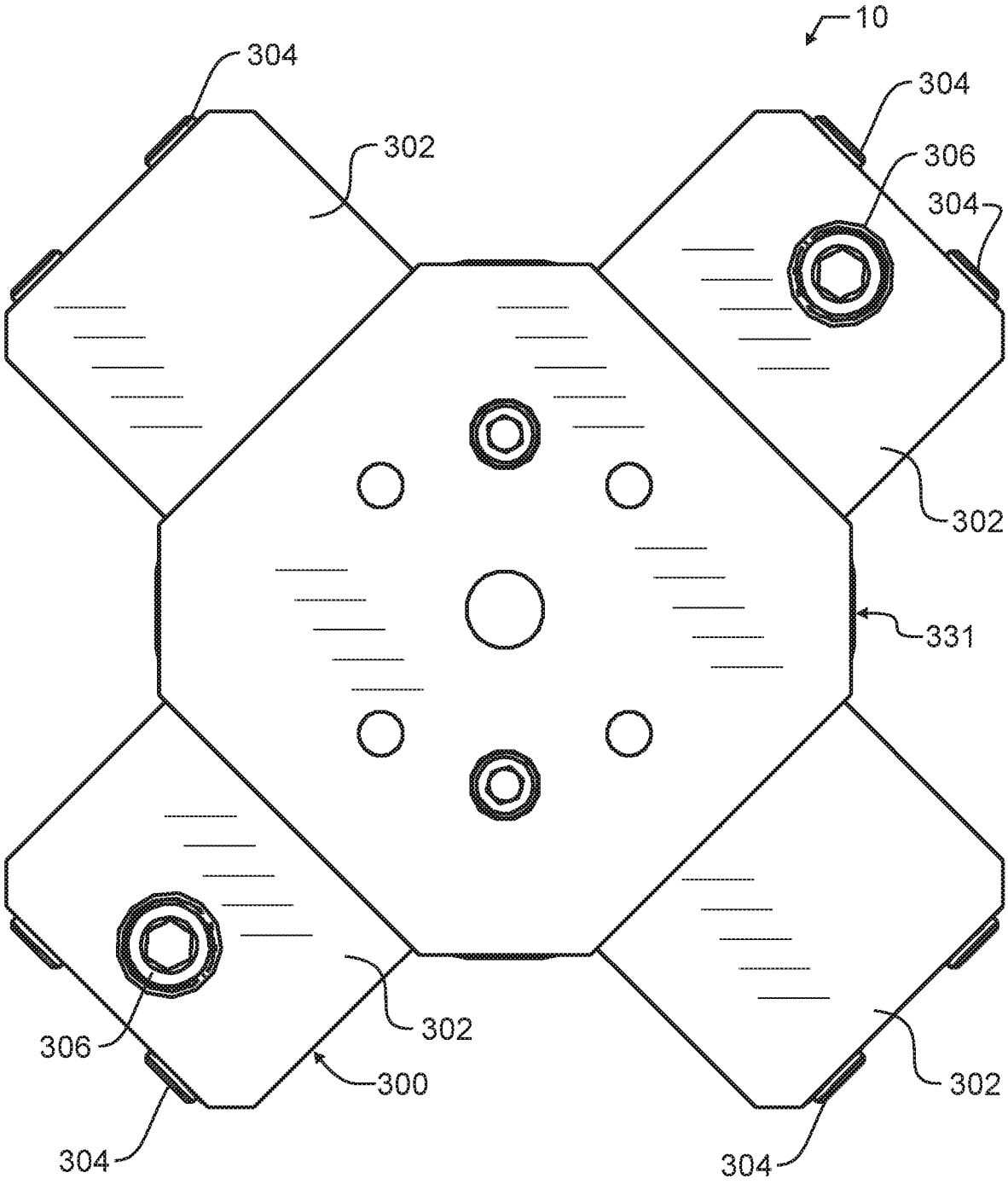
FIG. 4 illustrates the preferred embodiment compact pump of FIG. 1 from left side view.
Figure 9:
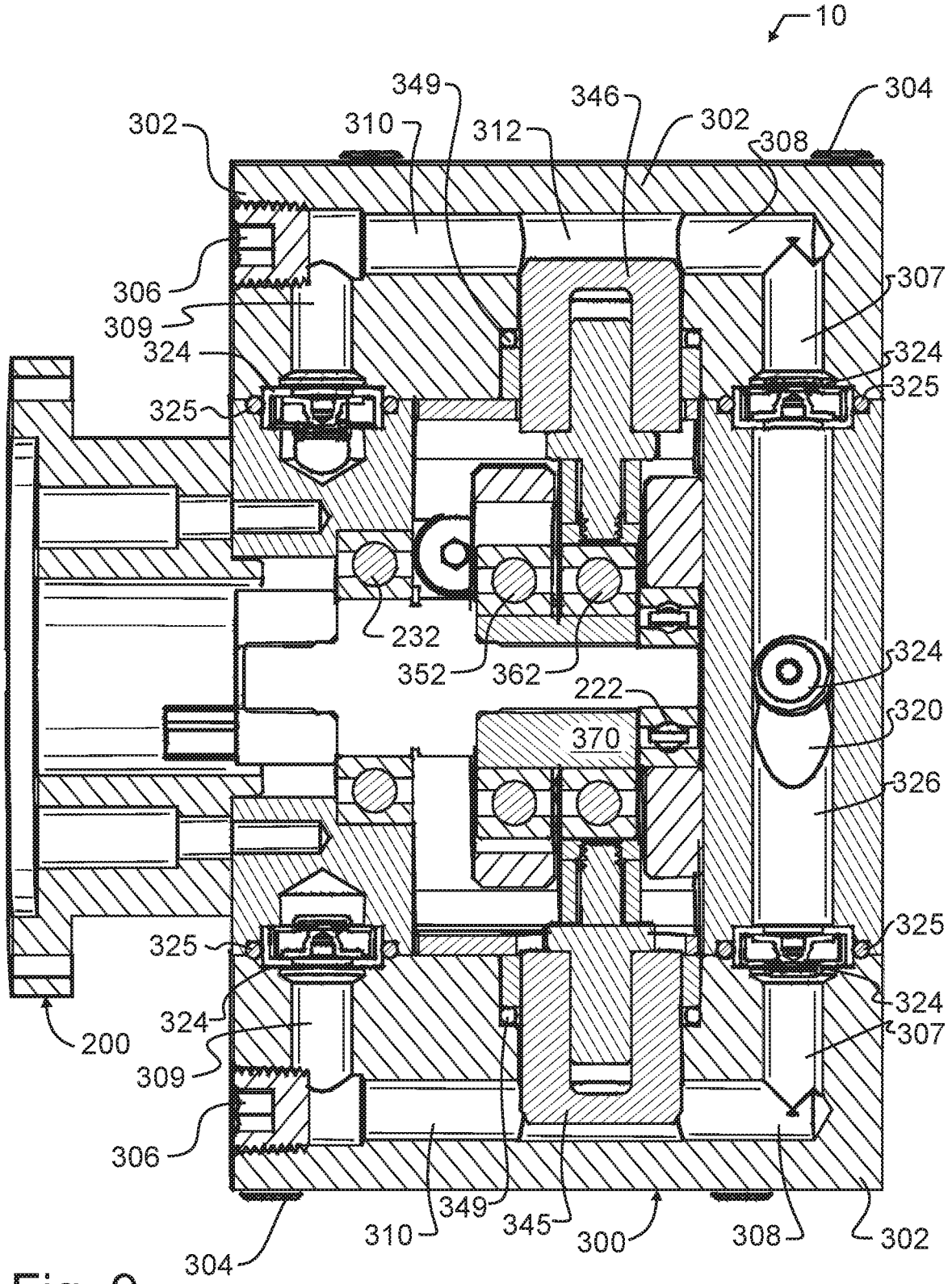
FIG. 9 illustrates the preferred embodiment compact pump from sectional view taken along line 9' of FIG. 4.

A single bore is drilled or otherwise formed in each of the four heads 302 that simultaneously defines both the longitudinal inlet bore 308 and the longitudinal outlet bore 310. Each of these longitudinal bores 308 and 310 are longitudinally parallel to the longitudinal axis of rotary drive shaft 220. Visible in FIGS. 3, 4, and 9 are threaded socket-head plugs 306 that are used to close off the otherwise exteriorly exposed open end of the bore that defines these longitudinal inlet bores 308 and longitudinal outlet bores 310.

Figure 6:
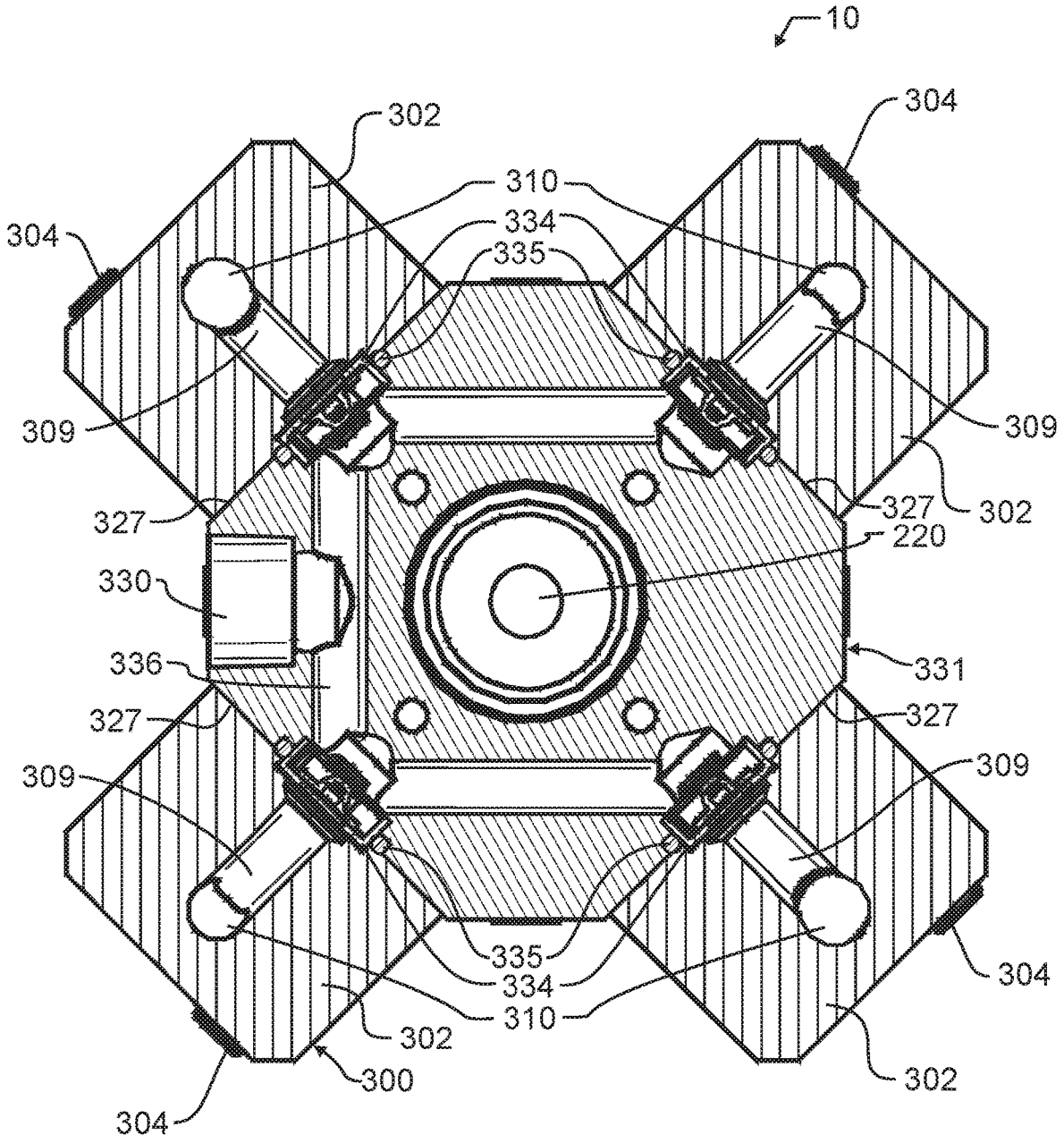
FIG. 6 illustrates the preferred embodiment compact pump of FIG. 1 from sectional view taken along line 6' of FIG. 2.

When fluid is expelled from a cylinder 312 by the associated piston 345-348, it will not be able to flow back into the radial inlet bore 307, owing to the one-way inlet valve 324 blocking flow in this direction. As a result, expelled fluid passes through longitudinal outlet bore 310 into radial outlet bore 309, and from there through one-way outlet valves 334 into outlet manifold 331 illustrated in FIG. 6. Each outlet valve 334 is sealed with an associated o-ring seal 335 in the same manner as the inlet valves 324 are sealed by o-ring seals 325.

Each of the four outlet valves 334 pass into a common outlet conduit 336 formed within outlet manifold 331 that is generally "U" shaped, and which is in fluid communication with outlet port 330. Outlet conduit 336 is bored into outlet manifold 331 again entirely from the exterior thereto, and the openings that would remain are conveniently capped by a slightly larger diameter bore used to seat valves 334. As with inlet port 320, outlet port 330 will in nearly all cases operatively be coupled to an exterior hose, conduit, or the like through suitable fitting, for exemplary and non-limiting purpose such as a threaded coupler.

Passing longitudinally through the center of pump body 300 is a rotary drive shaft 220, which is coupled with and driven by a suitable motor, the details of the motor which are not important to the present invention or illustrated herein. Generally centered relative to and affixed within each of intake manifold 321 and outlet manifold 331 are bearings 222, 232, respectively, visible in FIG. 9, that support rotary drive shaft 220. These bearings 222, 232 are in direct thermal communication with the inlet and outlet manifolds 321, 331, which in turn means that they are directly cooled by the liquid passing through the pump. As may be appreciated, this cooling helps to protect bearings 222, 232 from thermal overload and associated thermal degradation that can reduce the MTBF of a pump. In preferred embodiment compact pump 10, bearings 222, 232 are also preferably sealed bearings, which provides improved resistance to external contamination.

Within pump body 300 and also rigidly affixed with rotary drive shaft 220 is an eccentric cam 370. Cam 370 will rotate with rotary drive shaft 220, and on an exterior surface is provided with a pair of adjacent roller bearings 352, 362, both visible in FIG. 9. In preferred embodiment compact pump 10, bearings 352, 362 are preferably sealed bearings, which provides improved resistance to external contamination.

Figure 7:
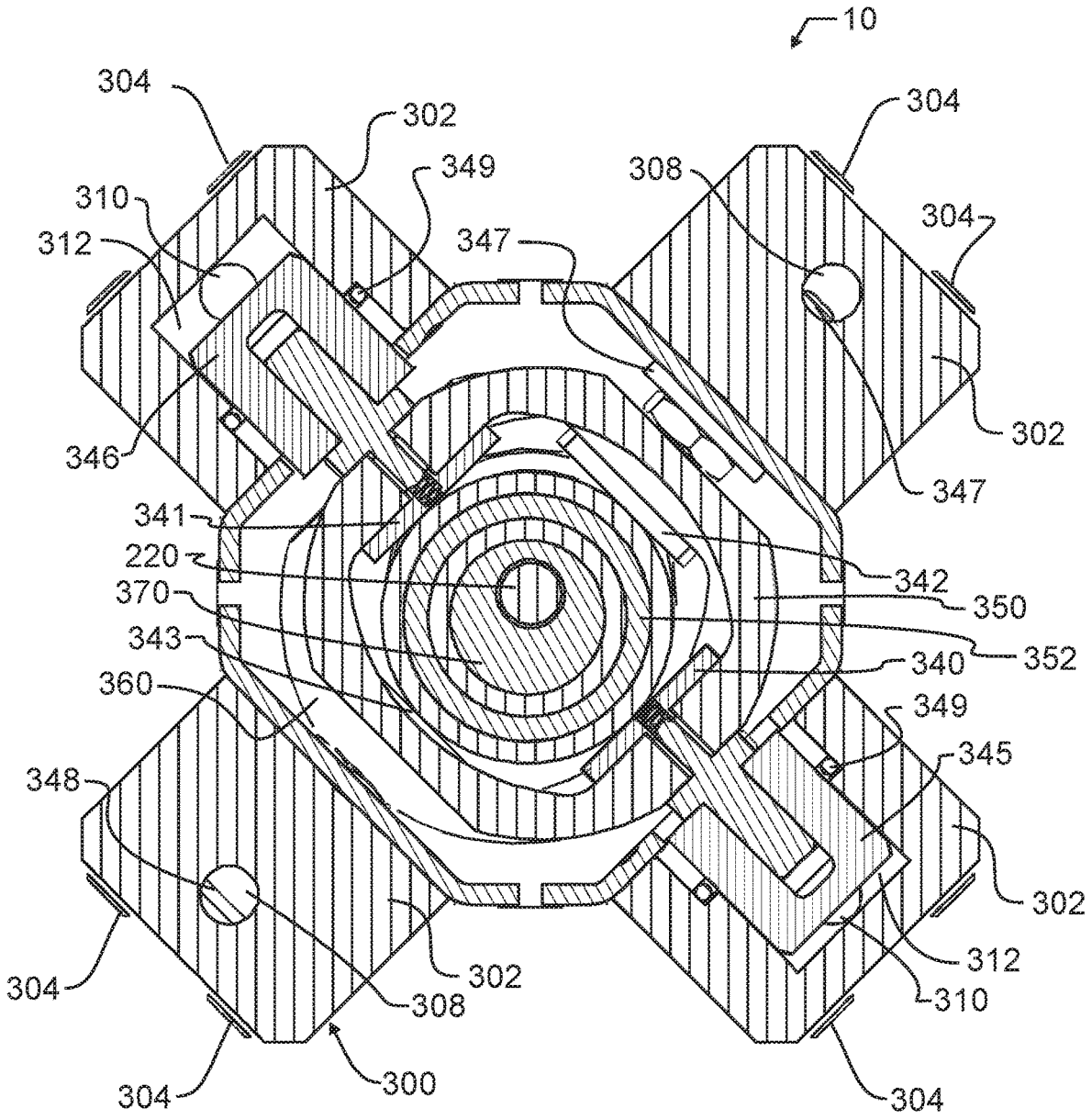
FIG. 7 illustrates the preferred embodiment compact pump of FIG. 1 from sectional view taken along line 7' of FIG. 1.
Figure 8:
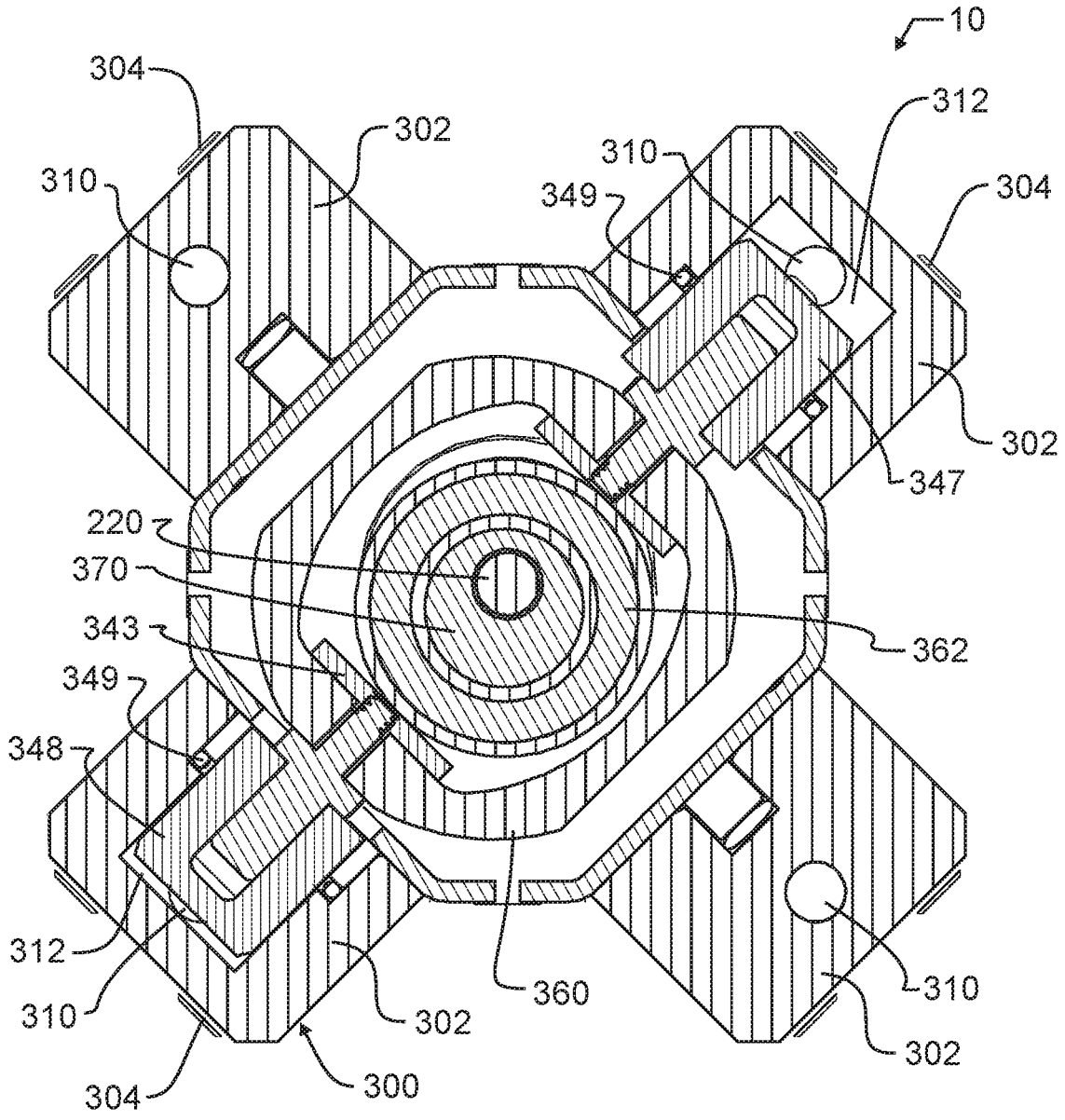
FIG. 8 illustrates the preferred embodiment compact pump of FIG. 1 from sectional view taken along line 8' of FIG. 1.

Each of these roller bearings 352, 362 drive one pair of the four pistons, through interaction with associated yoke contact surfaces 340-343. Opposed yoke contact surfaces 340 and 341 are in contact with a first bearing 352 of these two bearings, and form a part yoke 350 used to drive pistons 345 and 346. Opposed yoke contact surfaces 342 and 343 are in contact with a second bearing 362 of these two bearings, and form a second yoke 360 used to drive pistons 347 and 348. Each yoke 350, 360 visible in FIGS. 7 and 8 will be understood to have a name taken from the geometrically similar water and oxen yokes. Because the two yokes are angularly offset from each other by ninety degrees, at any given moment at least one of the four pistons is always pumping fluid. As a result, the preferred embodiment pump 10 is always pumping fluid and so is less susceptible to vibration and hammering than the prior art one and two piston pumps.

The use of yokes 350, 360 allows rotary drive shaft 220 to pass entirely through between the pistons, enabling the single shaft to drive both piston pairs. This also permits shaft 220 to be anchored into bearings 222, 232 within each of inlet and outlet manifolds 321, 331, as already described herein above.

As apparent from the Figures, each piston 345-348 has two associated one-way valves, an inlet valve 324 and an outlet valve 334, meaning the fluid will only flow from inlet to outlet, and not be circumvented by an adjacent piston.

Preferred embodiment pump 10 offers a very compact geometry, while providing liquid cooling of critical components and substantially reduced vibration within a positive displacement pump. Pump 10 further requires a minimum of components that can easily be machined or produced and assembled in a low cost manner. Pump 10 will preferably use sealed bearings within an atmospheric chamber, thereby reducing the need for special lubricant sprays or immersion baths and allowing any leakage to be either released to atmosphere or if so desired, collected and removed without harming bearings or other internal components. This use of an atmospheric chamber and the lack of an oil bath permits pump 10 to be oriented in any direction, either during use, transport or storage without fear of leakage of the oil.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A pump body comprising:

a fluid intake manifold having internal fluid inlet conduits;

a fluid outlet manifold having internal fluid outlet conduits;

a plurality of heads, each individual one of said plurality of heads defining a piston cylinder and defining a fluid flow path coupling with a one of said internal fluid inlet conduits and a one of said internal fluid outlet conduits, each individual one of said plurality of heads affixed to the fluid intake and outlet manifolds;

a plurality of one-way inlet valves and seals within said fluid flow path captured between individual ones of said plurality of heads and said fluid intake manifold; and a plurality of one-way outlet valves and seals captured between individual ones of said plurality of heads and said fluid outlet manifold;

wherein said fluid intake manifold further comprises a unitary body;

wherein said internal fluid inlet conduits further comprise bores formed within said fluid intake manifold unitary body; and wherein said internal fluid inlet conduit bores further comprise a pair of perpendicular bores, each one of said pair of perpendicular bores formed within and passing entirely through said fluid intake manifold unitary body.

2. The pump body of claim 1, wherein said fluid intake manifold further comprises a fluid inlet port formed within said fluid intake manifold unitary body and passing from an exterior of said fluid intake manifold unitary body to an intersection between each one of said pair of perpendicular bores and extending longitudinally at an angle intermediate between each one of said pair of perpendicular bores, said fluid inlet port adapted to be in fluid communication with an external source fluid.

3. A pump body comprising:

a fluid intake manifold having internal fluid inlet conduits;

a fluid outlet manifold having internal fluid outlet conduits;

a plurality of heads, each individual one of said plurality of heads defining a piston cylinder and defining a fluid flow path coupling with a one of said internal fluid inlet conduits and a one of said internal fluid outlet conduits, each individual one of said plurality of heads affixed to the fluid intake and outlet manifolds;

a plurality of one-way inlet valves and seals within said fluid flow path captured between individual ones of said plurality of heads and said fluid intake manifold; and a plurality of one-way outlet valves and seals captured between individual ones of said plurality of heads and said fluid outlet manifold;

wherein said fluid outlet manifold further comprises a unitary body;

wherein said internal fluid outlet conduits further comprise bores formed within said fluid outlet manifold unitary body; and wherein said internal fluid outlet conduit bores further comprise first and second parallel bores and a third bore perpendicular to said first and second parallel bores, each of said first, second, and third bores formed within and passing entirely through said fluid intake manifold unitary body.

4. The pump body of claim 3, wherein:

a first one of said plurality of one-way outlet valves and seals is juxtaposed at the junction between said first and third bores;

a second one of said plurality of one-way outlet valves and seals is juxtaposed at the junction between said second and third bores;

a third one of said plurality of one-way outlet valves and seals is juxtaposed at the end of said first bore distal to the junction between said first and third bores; and a fourth one of said plurality of one-way outlet valves and seals is juxtaposed at the end of said second bore distal to the junction between said second and third bores.

5. The pump body of claim 4, further comprising a fluid outlet port formed within said fluid outlet manifold unitary body and passing from an exterior of said fluid outlet manifold unitary body to at least one of said internal fluid outlet conduit bores, said fluid outlet port adapted to be in fluid communication with an external fluid conduit.

* * * * *